US012018547B2

(12) United States Patent
Bruce et al.

(10) Patent No.: US 12,018,547 B2
(45) **Date of Patent: *Jun. 25, 2024**

(54) DOWNHOLE APPARATUS WITH A VALVE ARRANGEMENT

(71) Applicant: Halliburton Manufacturing and Services Limited, London (GB)

(72) Inventors: Stephen Edmund Bruce, Aberdeen (GB); David Grant, Aberdeen (GB); Scott E. Wallace, Aberdeenshire (GB); Ewan Smith, Aberdeenshire (GB)

(73) Assignee: Halliburton Manufacturing and Services Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/081,032

(22) Filed: Dec. 14, 2022

(65) Prior Publication Data

US 2023/0116905 A1 Apr. 13, 2023

Related U.S. Application Data

(63) Continuation of application No. 17/203,454, filed on Mar. 16, 2021, now Pat. No. 11,542,779, which is a (Continued)

(30) Foreign Application Priority Data

May 3, 2016 (GB) ..... 1607710

(51) Int. Cl.
*E21B 34/10* (2006.01)
*E21B 34/14* (2006.01)
*E21B 43/10* (2006.01)

(52) U.S. Cl.
CPC ..... *E21B 34/103* (2013.01); *E21B 34/14* (2013.01); *E21B 43/108* (2013.01); *E21B 2200/06* (2020.05)

(58) Field of Classification Search
CPC ..... E21B 34/103; E21B 34/14; E21B 43/108; E21B 2200/06
See application file for complete search history.

(56) References Cited

U.S. PATENT DOCUMENTS 2,603,293 A 7/1952 Lynes
3,022,827 A 2/1962 William
(Continued)

FOREIGN PATENT DOCUMENTS

EP 2669466 12/2013
GB 2492193 12/2012
(Continued)

OTHER PUBLICATIONS

"Danish Patent and Trademark Office, Search Report, Application PA202070733", dated Dec. 15, 2020, 10 pages.
(Continued)

*Primary Examiner* — Dany E Akakpo
(74) *Attorney, Agent, or Firm* — DeLizio, Peacock, Lewin & Guerra, LLP

(57) ABSTRACT

A method of operating a valve arrangement of a downhole apparatus (that includes a tubular body having first and second ports in a wall thereof) comprising operating the valve arrangement from a locked first configuration, in which the first port is closed and the second port is closed, to a locked second configuration, in which the first port is open and the second port is closed, wherein the valve arrangement includes a valve member including a first port, the first port associated with the first port of the tubular body, and a second port associated with the second port of the tubular body, wherein the valve arrangement comprises a further retaining member. The method includes operating
(Continued)

the valve arrangement from the locked second configuration to a third configuration, in which the first port is closed and the second port is open.

28 Claims, 21 Drawing Sheets

Related U.S. Application Data continuation of application No. 16/098,433, filed as application No. PCT/GB2017/051223 on May 2, 2017, now Pat. No. 10,975,660.

(56) References Cited

U.S. PATENT DOCUMENTS

| | | | | |
|---|---|---|---|---|
| 3,581,819 | A | 6/1971 | Tamplen | |
| 4,560,005 | A | 12/1985 | Helderle et al. | |
| 6,220,357 | B1 | 4/2001 | Carmichael et al. | |
| 10,975,660 | B2 | 4/2021 | Bruce et al. | |
| 11,542,779 | B2 | 1/2023 | Bruce et al. | |
| 2003/0127227 | A1 | 7/2003 | Fehr et al. | |
| 2009/0044944 | A1 | 2/2009 | Murray et al. | |
| 2009/0139717 | A1 | 6/2009 | Richard et al. | |
| 2010/0044041 | A1 | 2/2010 | Smith et al. | |
| 2012/0048559 | A1 | 3/2012 | Ganguly et al. | |
| 2012/0073828 | A1 | 3/2012 | Churchill | |
| 2013/0168099 | A1* | 7/2013 | Themig | E21B 34/14 166/308.1 |
| 2013/0341005 | A1 | 12/2013 | Bruce et al. | |
| 2014/0174746 | A1 | 6/2014 | George et al. | |
| 2015/0027726 | A1 | 1/2015 | Bruce et al. | |
| 2015/0204168 | A1* | 7/2015 | Greci | E21B 43/10 166/230 |
| 2015/0275623 | A1 | 10/2015 | Russell | |
| 2016/0298424 | A1 | 10/2016 | Themig | |
| 2017/0067314 | A1 | 3/2017 | Flores Perez et al. | |
| 2017/0175488 | A1 | 6/2017 | Lisowski et al. | |
| 2017/0241238 | A1* | 8/2017 | Bacsik | E21B 43/14 |
| 2019/0178054 | A1 | 6/2019 | Bruce et al. | |
| 2021/0198978 | A1 | 7/2021 | Bruce et al. | |
| 2023/0108002 | A1 | 4/2023 | Bruce et al. | |
| 2023/0110319 | A1 | 4/2023 | Bruce et al. | |
| 2023/0111890 | A1 | 4/2023 | Bruce et al. | |
| 2023/0112439 | A1 | 4/2023 | Bruce et al. | |
| 2023/0113639 | A1 | 4/2023 | Bruce et al. | |
| 2023/0114574 | A1 | 4/2023 | Bruce et al. | |
| 2023/0116709 | A1 | 4/2023 | Bruce et al. | |
| 2023/0118919 | A1 | 4/2023 | Bruce et al. | |
| 2023/0135540 | A1 | 5/2023 | Bruce et al. | |

FOREIGN PATENT DOCUMENTS

| | | |
|---|---|---|
| GB | 2500109 | 9/2013 |
| WO | 2003023185 | 3/2003 |
| WO | 2008142409 | 11/2008 |
| WO | 2009001069 | 12/2008 |
| WO | 2009029437 | 3/2009 |
| WO | 2010119010 | 10/2010 |
| WO | 2012037645 | 3/2012 |
| WO | 2012066290 | 5/2012 |
| WO | 2014003756 | 1/2014 |
| WO | 2015076834 | 5/2015 |
| WO | 2015101783 | 7/2015 |
| WO | 2017191442 | 11/2017 |

OTHER PUBLICATIONS

"Examination Report issued for United Kingdom Patent Application No. GB1706932.9", dated Aug. 27, 2019, 3 pages.
"Intellectual Property Office Great Britain, Examination Report Application No. GB1607710.9", dated Jan. 29, 2021, 4 pages.
"MY Application No. PI 2018703500 Office Action", dated Jul. 31, 2022, 3 pages.
"Office Action and Search Report issued for Danish Patent Application No. PA201870703", dated Aug. 28, 2019, 8 pages.
"Office Action issued for Brazilian Patent Application No. 1120180725064", dated May 24, 2022, 4 pages.
"PCT Application No. PCT/GB2017/051223, International Preliminary Report on Patentability", dated Nov. 15, 2018, 13 pages.
"PCT Application Serial No. PCT/GB2017/051223, International Search Report and Written Opinion", dated Oct. 25, 2017, 16 pages.
"U.S. Appl. No. 16/098,433 Office Action", dated Apr. 24, 2020, 14 pages.
"U.S. Appl. No. 17/203,454 Office Action", dated Jul. 11, 2022, 12 pages.
"Written Opinion for Application No. 11201808468V by Intellectual Property Office of Singapore", dated Feb. 25, 2020, 7 pages.
"DK Application No. 202270437, Office Action", dated Oct. 27, 2022, 7 pages.
"CA Application No. 3,094,478, Third Examiner's Report", dated Jun. 23, 2023, 3 pages.
"U.S. Appl. No. 18/065,733, Non-Final Office Action", dated Apr. 12, 2023, 11 pages.
"U.S. Appl. No. 18/065,762, Non-Final Office Action", dated Mar. 30, 2023, 10 pages.
"U.S. Appl. No. 18/065,789, Non-Final Office Action", dated May 10, 2023, 13 pages.
"U.S. Appl. No. 18/065,825, Non-Final Office Action", dated May 11, 2023, 16 pages.
"U.S. Appl. No. 18/065,935, Non-Final Office Action", dated Apr. 21, 2023, 8 pages.
"U.S. Appl. No. 18/066,461, Non-Final Office Action", dated May 25, 2023, 11 pages.
"U.S. Appl. No. 18/078,537, Non-Final Office Action", dated Mar. 30, 2023, 12 pages.
"U.S. Appl. No. 18/080,990, Non-Final Office Action", dated May 10, 2023, 11 pages.
"U.S. Appl. No. 18/081,222, Non-Final Office Action", dated Apr. 26, 2023, 12 pages.
"U.S. Appl. No. 18/065,825, Final Office Action", dated Nov. 27, 2023, 7 pages.
"U.S. Appl. No. 18/066,461, Final Office Action", dated Dec. 6, 2023, 7 pages.
"U.S. Appl. No. 18/078,537, Final Office Action", dated Nov. 27, 2023, 7 pages.
"U.S. Appl. No. 18/080,990, Final Office Action", dated Nov. 14, 2023, 9 pages.

* cited by examiner

DOWNHOLE APPARATUS WITH A VALVE ARRANGEMENT

The present invention relates to downhole apparatus and in particular, but not exclusively, to flow control apparatus, such as sand screens, and methods of operating a valve arrangement of the same.

WO 2009/001069, WO 2009/001073 and WO 2013/132254, the disclosures of which are incorporated herein in their entirety, describe downhole apparatus and arrangements for supporting walls of boreholes and method of operating the valve arrangements thereof. The apparatus includes a plurality of activatable chambers mounted to a base pipe, such that activation of the chambers increases the diameter of the apparatus to at least match the diameter of the borehole. The activatable chambers are configured to support a downhole tool, such as a sand screen.

The present inventors have appreciated the shortcomings in the above-described apparatus and systems.

According to a first aspect of the present invention there is provided a downhole apparatus comprising:

- a tubular body, the tubular body having first and second ports in a wall thereof; and
- a valve arrangement, the valve arrangement having:
- a locked first configuration, in which the first port is closed and the second port is closed;
- a locked second configuration, in which the first port is open and the second port is closed; and
- a third configuration, in which the first port is closed and the second port is open.

According to a second aspect of the present invention there is provided a method of operating a valve arrangement of a downhole apparatus comprising a tubular body having first and second ports in a wall thereof, the method comprising the steps of:

- operating the valve arrangement from a locked first configuration, in which the first port is closed and the second port is closed, to a locked second configuration, in which the first port is open and the second port is closed; and
- operating the valve arrangement from the locked second configuration to a third configuration, in which the first port is closed and the second port is open.

According to third aspect of the present invention there is provided a valve arrangement for a downhole apparatus having a tubular body having first and second ports in a wall thereof, the valve arrangement being:

- configurable to be locked in a first configuration with the tubular body, such that the first port is closed and the second port is closed;
- configurable to be locked in a second configuration with the tubular body, such that the first port is open and the second port is closed; and
- configurable to be locked in a third configuration with the tubular body, such that the first port is closed and the second port is open.

According to a fourth aspect of the present invention there is provided a downhole apparatus comprising:

- a tubular body, the tubular body having two or more pairs of first and second ports in a wall thereof; and
- two or more valve arrangements, each valve arrangement being associated with a pair of first and second ports, and wherein each valve arrangement has:
- a locked first configuration, in which the first port is closed and the second port is closed;
- a locked second configuration, in which the first port is open and the second port is closed; and
- a third configuration, in which the first port is closed and the second port is open.

According to a fifth aspect of the present invention there is provided a method of operating a downhole apparatus, the downhole apparatus comprising:

- a tubular body, the tubular body having first and second ports in a wall thereof;
- a valve arrangement, the valve arrangement having:
- a locked first configuration, in which the first port is closed and the second port is closed;
- a locked second configuration, in which the first port is open and the second port is closed; and
- a third configuration, in which the first port is closed and the second port is open; and
- a sand control element, the sand control element being in fluid communication with the first port of the tubular body, the method comprising the steps of:
  - arranging the downhole apparatus in a wellbore; and
  - operating the valve arrangement to move the sand control element from a first position in which the sand control element is spaced from the surface of the wellbore to a second position in which the sand control element is in contact with the surface of the wellbore.

It should be appreciated that the wellbore may be the bore of a subterranean formation.

The method may comprise the further step of operating the valve arrangement to allow fluids to flow from the subterranean formation through the sand control element and into the downhole apparatus; or from the downhole apparatus through the sand control element into the subterranean formation. This step may be performed immediately after the step of operating the valve arrangement to move the sand control element from the first position to the second position. Alternatively, this step may be performed a prolonged period after the step of operating the valve arrangement to move the sand control element from the first position to the second position. This operation allows the downhole reservoir fluids (oil, gas, water) to flow from the formation through the sand screen filter element, through the flow ports of the valve arrangement into the bore and up to the well completion and out of the well; or from the well surface to downhole apparatus, through the sand screen filter element and into the formation.

The tubular body of the downhole apparatus may have two or more pairs of first and second ports in a wall thereof; and two or more valve arrangements, each valve arrangement being associated with a pair of first and second ports, and wherein each valve arrangement has: a locked first configuration, in which the first port is closed and the second port is closed; a locked second configuration, in which the first port is open and the second port is closed; and a third configuration, in which the first port is closed and the second port is open, and the method may comprise the further step of selectively operating each valve arrangement to move the sand control element from the first position to the second position and to allow fluids to flow from the subterranean formation through the sand control element and out of the downhole apparatus.

The selective operation of each valve arrangement may be through hydraulic operation, mechanical operation, or a combination of hydraulic operation and mechanical operation. This allows the reservoir to be produced sand-free, produced efficiently, more effectively drained or flooded with injected fluid; more effectively pressure managed; more effectively swept and formation fluids to be more easily displaced by injected fluids.

According to a sixth aspect of the present invention there is provided a downhole apparatus comprising:

a tubular body, the tubular body having first and second ports in a wall thereof;

a first valve arrangement associated with the first port; a second valve arrangement associated with the second port; and a sand control element, the sand control element being operable to move between a first deactivated state to a second activated state, wherein the sand control element is in fluid communication with the first port of the tubular body.

The first valve arrangement and the second valve arrangement may be independently operable. The first valve arrangement and the second valve arrangement may be sequentially operable. The first valve arrangement and the second valve arrangement may be located adjacent one another or spaced from one another within the tubular body.

In use, the first valve arrangement may be used to move the sand control element from a first position in which the sand control element is spaced from the surface of a wellbore to a second position in which the sand control element is in contact with the surface of the wellbore.

The second port of the tubular body may be configured such that, in use, fluids may flow from a subterranean formation through the sand control element and into the downhole apparatus, or from the downhole apparatus through the sand control element into a subterranean formation.

The first valve arrangement may be an activation valve arrangement. The second valve arrangement may be a production valve arrangement.

It should be appreciated that the wellbore may be the bore of a subterranean formation.

The first and second valve arrangement may have:

a first configuration, in which the first and second valve arrangements are locked and the first and second ports are closed;

a second configuration, in which the first and second valve arrangements are locked, the first port is open and the second port is closed; and a third configuration, in which the first valve arrangement is locked, the first port is closed and the second port is open.

According to a seventh aspect of the present invention there is provided a method of operating a downhole apparatus, the downhole apparatus comprising:

a tubular body, the tubular body having first and second ports in a wall thereof;

a first valve arrangement associated with the first port;

a second valve arrangement associated with the second port; and a sand control element, the sand control element being in fluid communication with the first port of the tubular body and being operable to move between a first deactivated state to a second activated state, the method comprising the steps of:

operating the first valve arrangement to move the sand control element from the first position to the second position; and operating the second valve arrangement to open the second port of the tubular body.

The tubular body may comprise a first portion and a second portion. The first portion may be an upper portion and the second portion may be a lower portion.

The locked first configuration may be an initial configuration of the valve arrangement. The locked first configuration may be an initial configuration of the downhole apparatus. In this configuration the downhole apparatus may be run into a bore hole. This is termed run-in-hole (RIH) configuration. The apparatus may already be positioned in a bore hole.

The locked first configuration may be followed by the locked second configuration. The locked second configuration may be followed by the third configuration.

The method may comprise an initial step of running the downhole apparatus into a bore hole. The apparatus may be in the locked first configuration in this step.

The valve arrangement may have a first intermediate configuration between the locked first configuration and the locked second configuration, in which the valve arrangement is unlocked and the first and second ports are closed. The method may comprise the further step of unlocking the valve arrangement from the locked first configuration. The method may comprise the further step of arranging the valve arrangement in the first intermediate configuration.

The valve arrangement may have a second intermediate configuration between the locked second configuration and the third configuration, in which the valve arrangement is unlocked and the first and second ports are closed. The method may comprise the further step of unlocking the valve arrangement from the locked second configuration. The method may comprise the further step of arranging the valve arrangement in the second intermediate configuration.

The third configuration may be an unlocked configuration. The third configuration may be a locked configuration. The method may comprise the further step of locking the valve arrangement in the third configuration.

The valve arrangement may have a fourth configuration, in which the first port is closed and the second port is closed. The fourth configuration may be reached after the valve arrangement has been moved through the first, second and third configurations. The fourth configuration may be an unlocked configuration. The fourth configuration may be a locked configuration. The fourth configuration may be achieved by mechanical intervention. The method may comprise the further step of operating the valve arrangement from the third configuration to the fourth configuration. The method may comprise the further step of locking the valve arrangement in the fourth configuration.

The valve arrangement may be a fluid pressure-responsive valve arrangement. The valve arrangement may be a hydraulically-actuated valve arrangement. The valve arrangement may be hydraulically-actuated. The first configuration may be associated with a first fluid pressure, the second configuration may be associated with a second fluid pressure, the second fluid pressure being higher than the first fluid pressure, and the third configuration may be associated with a third fluid pressure, the third fluid pressure being lower than the second fluid pressure.

Fluid pressure may be applied to the apparatus from the surface by one or more fluid pressure providing apparatus. The fluid pressure applied to the apparatus may be selectively adjustable.

The first fluid pressure may be approximately 0 psi (approx. 0 bar).

The second fluid pressure may be between approximately 2000 psi (approx. 138 bar) to 4000 psi (approx. 275 bar). The second fluid pressure may be between approximately 2500 psi (approx. 172 bar) to 3500 psi (approx. 241 bar). The second fluid pressure may be approximately 3000 psi (approx. 207 bar).

The third fluid pressure may be approximately 0 psi (approx. 0 bar). The third fluid pressure may be between approximately 0 psi (approx. 0 bar) and 350 psi (approx. 24 bar). The third fluid pressure may be between approximately 0 psi (approx. 0 bar) and 800 psi (approx. 55 bar).

The method may comprise the step of applying fluid pressure to the valve arrangement to move the valve arrangement from the locked first configuration to the locked second configuration. This step may unlock the valve arrangement from the locked first configuration. This step may move the valve arrangement to the first intermediate configuration. The method may comprise the further step of reducing the fluid pressure to move the valve arrangement to the locked second configuration. The method may comprise the steps of applying fluid pressure to the valve arrangement to unlock the valve arrangement from the locked first configuration and reducing the fluid pressure to move the valve arrangement to the locked second configuration.

The method may comprise the step of applying fluid pressure to the valve arrangement to move the valve arrangement from the locked second configuration to the third configuration. This step unlocks the valve arrangement from the locked second configuration. This step may move the valve arrangement to the second intermediate configuration. The method may comprise the further step of reducing the fluid pressure to move the valve arrangement to the third configuration. The method may comprise the steps of applying fluid pressure to the valve arrangement to unlock the valve arrangement from the locked second configuration and reducing the fluid pressure to move the valve arrangement to the third configuration.

The second intermediate configuration may be associated with a fluid pressure that is higher than the third fluid pressure. This may be a fourth fluid pressure. The second intermediate configuration may be associated with a fluid pressure that is initially higher than the third fluid pressure, but decreases towards the third fluid pressure.

The fourth fluid pressure may be between approximately 400 psi (approx. 28 bar) to 800 psi (approx. 55 bar). The fourth fluid pressure may be between approximately 500 psi (approx. 34 bar) to 700 psi (approx. 48 bar). The fourth fluid pressure may be approximately 600 psi (approx. 41 bar).

The valve arrangement may be a mechanically-actuated valve arrangement. The valve arrangement may be adapted for mechanical actuation. The valve arrangement may be actuated by an intervention tool, shifting tool, downhole accessory, or the like. The method may comprise the step of moving the valve arrangement between configurations by an intervention tool, shifting tool, downhole accessory, or the like.

The valve arrangement may be a combination of a fluid pressure-responsive valve arrangement and a mechanically-actuated valve arrangement. That is, the valve arrangement may be operable by way of pressurised fluid and/or mechanical actuation.

The valve arrangement may include a valve member.

The valve member may include a first port, the first port being associated with the first port of the tubular body. The valve member may include a second port, the second port being associated with the second port of the tubular body. The valve member may be moveable with respect to the tubular body to open and/or close the first and second ports of the tubular body.

The valve member may be operable to close the first port in the first configuration. The valve member may be operable to close the second port in the first configuration. The valve member may be operable to close the first and second ports in the first configuration. The method may comprise the step of operating the valve member to close the first and second ports in the locked first configuration.

The valve member may be operable to open the first port in the second configuration. The valve member may be operable to close the second port in the second configuration. The valve member may be operable to open the first port in the second configuration and close the second port in the second configuration. The method may comprise the step of operating the valve member to open the first port and close the second port in the locked second configuration.

The valve member may be operable to close the first port in the third configuration. The valve member may be operable to open the second port in the third configuration. The valve member may be operable to close the first port in the third configuration and open the second port in the third configuration. The method may comprise the step of operating the valve member to close the first port and open the second port in the third configuration.

The valve member may be operable to close the first port in the fourth configuration. The valve member may be operable to close the second port in the fourth configuration. The valve member may be operable to close the first and second ports in the fourth configuration. The method may comprise the step of operating the valve member to close the first and second ports in the fourth configuration.

The valve member may be operable to close the first port in the first intermediate configuration. The valve member may be operable to close the second port in the first intermediate configuration. The valve member may be operable to close the first and second ports in the first intermediate configuration. The method may comprise the step of operating the valve member to close the first and second ports in the first intermediate configuration.

The valve member may be operable to close the first port in the second intermediate configuration. The valve member may be operable to close the second port in the second intermediate configuration. The valve member may be operable to close the first and second ports in the second intermediate configuration. The method may comprise the step of operating the valve member to close the first and second ports in the second intermediate configuration.

The valve member may be a sleeve. The valve member may be a sleeve member. The valve member may be located within the tubular body.

The downhole apparatus may further comprise a biasing device. The biasing device may be operable to apply a biasing force to the valve member. The biasing device may be a spring member. The method may comprise the step of applying a biasing force to the valve member.

The valve member may be biased towards a position where the second port is open. The valve member may be biased by the biasing device towards a position where the second port is open. The method may comprise the step of biasing the valve member to a position where the second port is open.

The valve arrangement may comprise one or more locking devices. The locking devices may be configured to lock the valve member in place relative to the tubular body. The locking devices may be retaining members. The retaining members may be configured to lock in grooves in the tubular body.

The one or more locking devices may be releasable locking devices, or lock devices. The retaining members may be shear pins or screws, shear rings, or the like. The retaining members may be a plurality of shear pins or screws, shear rings, or the like.

The locking devices, or lock devices, may be ratchet rings, collet fingers, body lock ring, snap latch, or the like. The valve arrangement may comprise a ratchet ring locking device. The valve member may comprise one or more collet fingers.

The valve arrangement may comprise one or more primary retaining members and one or more secondary retaining members. The primary and secondary retaining members may be shear pins or screws, or the like. The primary retaining members may hold the valve member in a first position relative to the tubular body. The secondary retaining members may hold the valve member in a second position relative to the tubular body. The primary retaining members may hold the valve arrangement in the locked first configuration. The secondary retaining members may hold the valve arrangement in the locked second configuration. The primary and secondary retaining members may be releasable retaining members. In the locked first configuration the primary retaining members are engaged with the valve member to hold the valve member in the locked position and the second retaining members are disengaged from the valve member. In the locked second configuration the primary retaining members are disengaged from the valve member and the second retaining members are engaged with the valve member to hold the valve member in the locked position. The second retaining members may be biased towards the valve member. The second retaining members may be biased towards the valve member by a spring member, or the like. The retaining members may be configured to lock in grooves in the tubular body. The method may comprise the step of engaging the second retaining members with the valve member when the valve member is in the locked second configuration.

The valve arrangement may comprise a further retaining member. The further retaining member may be a ratchet ring, collet fingers, shear ring, or the like. The further retaining member may hold the valve member in the locked third configuration. The further retaining member may hold the valve member in the third configuration. Sections, or elements, of the valve member may be configured to engage with corresponding sections, or elements, of the tubular body to hold and lock the valve member in position relative to the tubular body. The further retaining member may be a non-releasable retaining member, or lock. The further retaining member may be a releasable retaining member, or lock. The method may comprise the step of locking the valve member in the third configuration with the further retaining member.

The valve arrangement may include a piston device. The piston device may be operable to arrange the valve arrangement in the first, second or third configuration. The piston device may be operable to arrange the valve arrangement in the first, second, third or fourth configurations. The piston device may be operable to arrange the valve arrangement in the first intermediate configuration and/or the second intermediate configuration. The piston device may be operable to move the valve member relative to the tubular body. The method may comprise the step of operating the piston device to arrange the valve arrangement in the first, second, third or fourth configurations. The method may comprise the step of operating the piston device to arrange the valve arrangement in the first intermediate configuration and/or the second intermediate configuration.

The piston device may be a differential pressure piston device. The valve arrangement may define the piston device. The valve arrangement may define the differential pressure piston device. The valve arrangement may define a differential pressure piston. The differential pressure piston may be formed between the valve member and the tubular body.

The differential piston device may operate between a first operating surface area and a second operating surface area. The second operating surface area may be smaller than the first operating surface area. The differential piston may have a first operating surface which may be exposed to an internal tubular body fluid pressure and a second operating surface which may be subject to a biasing force from the biasing device. The biasing device may be located between the second operating surface, which is defined by the valve member, and the tubular body. The biasing device may exert a biasing force on the second operating surface of the piston device. The biasing device may be operable to bias the valve member to a position where the second port is open. The method may comprise the step of operating the differential pressure piston device to arrange the valve arrangement in the first, second, third or fourth configurations. The method may comprise the step of operating the differential pressure piston device by controlling the internal tubular body fluid pressure to arrange the valve arrangement in the first, second, third or fourth configurations.

The valve arrangement may comprise one or more pressure balancing ports. The tubular body may comprise one or more pressure balancing ports. The pressure balancing ports may be provided in the wall of the tubular body. The pressure balancing ports may provide fluid communication between the inside and outside of the tubular body. The one or more pressure balancing ports may be associated with the differential pressure piston. The second operating surface of the differential pressure piston may be exposed to an external fluid pressure by the one or more pressure balancing ports, i.e., the second operating surface of the differential pressure piston may be exposed to a fluid pressure between the tubular body and the well bore, such as annulus pressure. The second operating surface may therefore be subject to fluid pressure in the annulus between the tubular body and the well bore and a biasing force from the biasing device. The method may comprise the step of balancing the fluid pressure between the inside and outside of the tubular body. The method may comprise the step of balancing the fluid pressure between the inside and outside of the tubular body by controlling the internal tubular body fluid pressure. This step may be carried out in the initial configuration, where the downhole apparatus is run into the bore hole.

Operation of the valve member may therefore be determined by the differential pressure between the first and second operating surfaces of the differential pressure piston device. Operation of the valve member may also be determined by the biasing member in absence of fluid pressure.

The first port may be configured to permit fluid to flow through the port in one direction and prevent fluid to flow through the port in an opposite direction. The first port may be configured to permit fluid to flow through the wall of the tubular body, from the inside of the tubular body to the outside of the tubular body. The method may comprise the step of communicating fluid through the first port.

The first port may include a check valve. The check valve may be configured to permit fluid to flow through the valve in one direction and prevent fluid to flow through the valve in an opposite direction. The check valve may be configured to permit fluid to flow through the port from the inside of the tubular body to the outside of the tubular body.

The first port may provide fluid communication with a tool or a device. The tool or device may be a downhole tool or device. The first port may provide fluid communication with a chamber. The chamber may be a deformable chamber.

The chamber may be a fluid deformable chamber. The device may be a fluid deformable device. The fluid deformable device or chamber may provide support to a sand screen (sand control element). The fluid deformable device may be operable to activate the sand screen. The fluid deformable device or chamber may deform from a first deactivated state to a second activated state. The sand screen may be activated when the fluid deformable device or chamber is in the second activated state. The fluid deformable device or chamber may be mounted on the tubular body. The fluid deformable device or chamber may be mounted on an external surface of the tubular body. The method may comprise the step of communicating fluid through the first port to the tool, device, chamber or deformable chamber. The method may comprise the step of communicating fluid through the first port to activate and extend the sand screen to a borehole wall. The method may comprise the step of communicating fluid through the first port to activate the sand screen.

The first port may be an activation port.

The downhole apparatus may comprise a plurality of first ports. Each first port may be configured to permit fluid to flow through the port in one direction and prevent fluid to flow through the port in an opposite direction. Each first port may be configured to permit fluid to flow through the wall of the tubular body, from the inside of the tubular body to the outside of the tubular body. The method may comprise the step of communicating fluid through each first port.

Each first port may include a check valve. Each check valve may be configured to permit fluid to flow through the valve in one direction and prevent fluid to flow through the valve in an opposite direction. Each check valve may be configured to permit fluid to flow through the port from the inside of the tubular body to the outside of the tubular body.

Each first port may provide fluid communication with a tool or a device. The tool or device may be a downhole tool or device. Each first port may provide fluid communication with a chamber. The chamber may be a deformable chamber. The chamber may be a fluid deformable chamber. The device may be a fluid deformable device. The fluid deformable device or chamber may provide support to a sand screen (sand control element). The fluid deformable device may be operable to activate the sand screen. The fluid deformable device or chamber may deform from a first deactivated state to a second activated state. The sand screen may be activated when the fluid deformable device or chamber is in the second activated state. The sand screen may be extended to a borehole wall when the fluid deformable device or chamber is in the second activated (fluid filled) state. The fluid deformable device or chamber may be mounted on the tubular body. The fluid deformable device or chamber may be mounted on an external surface of the tubular body. The method may comprise the step of communicating fluid through each first port to the tool, device, chamber or deformable chamber. The method may comprise the step of communicating fluid through the first port to activate and extend the sand screen to a borehole wall. The method may comprise the step of communicating fluid through each first port to activate the sand screen.

The downhole tool or device may be a packer, hanger, sand screen, or bore wall-supporting device.

The second port may provide fluid communication between the interior of the tubular body and the exterior of the tubular body. The fluid communication may be in either direction between the interior and exterior of the tubular body. The second port may be configured to permit flow of production fluid from a formation into the tubular body, and/or to permit treatment fluid to flow from the tubular body to the formation. The method may comprise the step of communicating fluid through the second port.

The second port may include an inflow control device (ICD).

The second port may be a production port.

The downhole apparatus may comprise a plurality of second ports. Each second port may provide fluid communication between the interior of the tubular body and the exterior of the tubular body. The fluid communication may be in either direction between the interior and exterior of the tubular body. Each second port may be configured to permit flow of production fluid from a formation into the tubular body, and/or to permit treatment fluid to flow from the tubular body to the formation. The treatment fluid may pass through a sand filter to the formation. The method may comprise the step of communicating fluid through each second port.

The tubular body may have a plurality of first and second ports in the wall thereof.

The downhole apparatus may comprise two or more valve arrangements, each valve arrangement being associated with a first port and a second port, or a pair of first and second ports. Each valve arrangement may be associated with a respective downhole tool or device. Each valve arrangement may be associated with a respective packer, hanger, sand screen, or bore wall-supporting device. The method may comprise the step of operating each valve arrangement.

Each valve arrangement of the downhole apparatus may be operated simultaneously. Each valve arrangement of the downhole apparatus may be operated independently. Each valve arrangement of the downhole apparatus may be operated sequentially. The method may comprise the step of operating each valve arrangement simultaneously, independently or sequentially.

The valve arrangement may comprise a first valve arrangement and a second valve arrangement. The first valve arrangement may be associated with the first port and the second valve arrangement may be associated with the second port. The first valve arrangement and the second valve arrangement may be independently operable. The first valve arrangement and the second valve arrangement may be sequentially operable. The first valve arrangement and the second valve arrangement may be arranged axially along the tubular body. The first valve arrangement and the second valve arrangement may be located adjacent one another or spaced from one another. The method may comprise the step of operating the first valve arrangement and the second valve arrangement. The method may comprise the step of operating the first valve arrangement and the second valve arrangement independently and/or sequentially.

The first valve arrangement may be an activation valve arrangement. The second valve arrangement may be a production valve arrangement.

The first and second valve arrangement may have:

- a first configuration, in which the first and second valve arrangements are locked and the first and second ports are closed;
- a second configuration, in which the first and second valve arrangements are locked, the first port is open and the second port is closed; and
- a third configuration, in which the first valve arrangement is locked, the first port is closed and the second port is open.

The method may comprise the steps of operating the first and second valve arrangements from the locked first configuration to the locked second configuration, and the locked second configuration to the third configuration.

The first configuration may be an initial configuration of the valve arrangement. The first configuration may be an initial configuration of the downhole apparatus. In this configuration the downhole apparatus may be run into a bore hole. This is termed run-in-hole (RIH) configuration. The apparatus may already be positioned in a bore hole.

The locked first configuration may be followed by the locked second configuration. The locked second configuration may be followed by the third configuration.

The method may comprise an initial step of running the downhole apparatus into a bore hole. The apparatus may be in the locked first configuration in this step.

The first and second valve arrangements may have a first intermediate configuration between the first configuration and the second configuration, in which the first valve arrangement is unlocked, the second valve arrangement is locked and the first and second ports are closed. The method may comprise the further step of unlocking the first valve arrangement from the locked first configuration. The method may comprise the further step of arranging the first and second valve arrangements in the first intermediate configuration.

The first and second valve arrangements may have a second intermediate configuration between the second configuration and the third configuration, in which the first valve arrangement is unlocked, the second valve arrangement is locked and the first and second ports are closed. The method may comprise the further step of unlocking the first valve arrangement from the locked second configuration. The method may comprise the further step of arranging the first and second valve arrangement in the second intermediate configuration.

The first and second valve arrangements may have a third intermediate configuration between the second intermediate configuration and the third configuration, in which the first valve arrangement is locked, the second valve arrangement is locked and the first and second ports are closed. The method may comprise the further step of arranging the first and second valve arrangements in the third intermediate configuration.

The first and second valve arrangements may have a fourth intermediate configuration between the third intermediate configuration and the third configuration, in which the first valve arrangement is locked, the second valve arrangement is unlocked and the first and second ports are closed. The method may comprise the further step of arranging the first and second valve arrangement in the fourth intermediate configuration.

The third configuration may be an unlocked configuration. The third configuration may be a locked configuration. The first and second valve arrangements may be locked in the third configuration. The method may comprise the further step of locking the first and second valve arrangements in the third configuration.

The valve arrangement may have a fourth configuration, in which the first port is closed and the second port is closed. The fourth configuration may be reached after the first and second valve arrangement have been moved through the first, second and third configurations. The fourth configuration may be an unlocked configuration. The fourth configuration may be a locked configuration. The fourth configuration may be achieved by mechanical intervention. The method may comprise the further step of operating the first and second valve arrangements from the third configuration to the fourth configuration. The method may comprise the further step of locking the first and second valve arrangement in the fourth configuration.

The valve arrangement may be a fluid pressure-responsive valve arrangement. The valve arrangement may be a hydraulically-actuated valve arrangement. The valve arrangement may be hydraulically-actuated.

The first configuration may be associated with a first fluid pressure, the second configuration may be associated with a second fluid pressure, the second fluid pressure being higher than the first fluid pressure, and the third configuration may be associated with a third fluid pressure, the third fluid pressure being lower than the second fluid pressure.

The third intermediate configuration may be associated with a fluid pressure that is higher than the third fluid pressure. The third intermediate configuration may be associated with a fluid pressure that is initially higher than the third fluid pressure, but decreases towards the third fluid pressure.

The fourth intermediate configuration may be associated with a fluid pressure that is higher than the first fluid pressure. The fourth intermediate configuration may be associated with a fluid pressure that is initially higher than the first fluid pressure, but decreases towards the third fluid pressure. This may be a fourth fluid pressure. The fourth fluid pressure may be higher than the second fluid pressure.

The method may comprise the step of applying fluid pressure to the valve arrangement to move the first and second valve arrangement from the locked first configuration to the locked second configuration. This step may unlock the first valve arrangement from the locked first configuration. This step may move the first and second valve arrangements to the first intermediate configuration. The method may comprise the further step of reducing the fluid pressure to move the first and second valve arrangements to the locked second configuration. The method may comprise the steps of applying fluid pressure to the valve arrangement to unlock the first valve arrangement from the locked first configuration and reducing the fluid pressure to move the first and second valve arrangements to the locked second configuration.

The method may comprise the step of applying fluid pressure to the valve arrangement to move the first and second valve arrangements from the locked second configuration to the second intermediate configuration. This step unlocks the first valve arrangement from the locked second configuration. This step may move the first and second valve arrangements to the second intermediate configuration. The method may comprise the further step of reducing the fluid pressure to move the first and second valve arrangements to the third intermediate configuration.

The method may comprise the step of applying fluid pressure to the valve arrangement to move the first and second valve arrangements from the third intermediate configuration to the fourth intermediate configuration. This step unlocks the second valve arrangement from the locked third intermediate configuration. This step may move the first and second valve arrangements to the fourth intermediate configuration. The method may comprise the further step of reducing the fluid pressure to move the first and second valve arrangement to the third configuration.

The valve arrangement may be a mechanically-actuated valve arrangement. The first and second valve arrangements may be mechanically-actuated valve arrangements. The first and second valve arrangements may be adapted for mechanical actuation. The first and second valve arrangements may be actuated by an intervention tool, shifting tool, or the like. The method may comprise the step of moving the first and second valve arrangements between configurations by an intervention tool, shifting tool, downhole accessory, or the like.

The first and second valve arrangements may be mechanically actuated through the above-referenced configurations. The first and second valve arrangements may be mechanically actuated through the first configuration, the second configuration, the third configuration, the first intermediate configuration, the second intermediate configuration and the fourth intermediate configuration.

The valve arrangement may be a combination of a fluid pressure-responsive valve arrangement and a mechanically-actuated valve arrangement. That is, the valve arrangement may be operable by way of pressurised fluid and/or mechanical actuation. The first valve arrangement may be a fluid pressure-responsive valve arrangement or a mechanically actuated valve arrangement. The second valve arrangement may be a fluid pressure-responsive valve arrangement or a mechanically actuated valve arrangement.

The first valve arrangement may include a first valve member. The second valve arrangement may include a second valve member.

The first valve member may include a first port, the first port being associated with the first port of the tubular body. The second valve member may include a second port, the second port being associated with the second port of the tubular body. The first and second valve members may be moveable with respect to the tubular body to open and/or close the first and second ports of the tubular body.

The first valve member may be operable to close the first port in the first configuration. The method may comprise the step of operating the first valve member to close the first port in the locked first configuration.

The first valve member may be operable to open the first port in the second configuration. The method may comprise the step of operating the first valve member to open the first port in the locked second configuration.

The first valve member may be operable to close the first port in the third configuration. The method may comprise the step of operating the first valve member to close the first port in the third configuration.

The first valve member may be operable to close the first port in the fourth configuration. The method may comprise the step of operating the first valve member to close the first port in the fourth configuration.

The first valve member may be a sleeve. The first valve member may be a sleeve member. The first valve member may be located within the tubular body.

The downhole apparatus may further comprise a biasing device. The biasing device may be operable to apply a biasing force to the first valve member. The biasing device may be a spring member. The method may comprise the step of applying a biasing force to the first valve member.

The first valve member may be biased towards a position where the first port is closed. The method may comprise the step of biasing the first valve member to a position where the first port is closed.

The first valve arrangement may comprise one or more locking devices. The locking devices may be configured to lock the first valve member in place relative to the tubular body. The locking devices may be retaining members. The retaining members may be configured to lock in grooves in the tubular body.

The locking devices may be releasable locking devices, or lock devices. The retaining members may be shear pins or screws, shear rings, or the like. The retaining members may be a plurality of shear pins or screws, shear rings, or the like.

The locking devices, or lock devices, may be ratchet rings, collet fingers, body lock ring, snap latch, or the like. The first valve arrangement may comprise a ratchet ring locking device. The first valve arrangement may comprise one or more collet fingers.

The first valve arrangement may comprise one or more primary retaining members and one or more secondary retaining members. The primary and secondary retaining members may be shear pins or screws, or the like. The primary retaining members may hold the first valve member in a first position relative to the tubular body. The secondary retaining members may hold the first valve member in a second position relative to the tubular body. The primary retaining members may hold the first valve arrangement in the locked first configuration. The secondary retaining members may hold the first valve arrangement in the locked second configuration. The primary and secondary retaining members may be releasable retaining members. In the locked first configuration the primary retaining members are engaged with the first valve member to hold the first valve member in the locked position and the second retaining members are disengaged from the first valve member. In the locked second configuration the primary retaining members are disengaged from the first valve member and the second retaining members are engaged with the first valve member to hold the first valve member in the locked position. The second retaining members may be biased towards the first valve member. The second retaining members may be biased towards the first valve member by a spring member, or the like. The retaining members may be configured to lock in grooves in the tubular body. The method may comprise the step of engaging the second retaining members with the first valve member when the first valve member is in the locked second configuration.

The first valve arrangement may comprise a further retaining member. The further retaining member may be a ratchet ring, collet fingers, shear ring, or the like. The further retaining member may hold the first valve member in the locked third intermediate configuration. Sections, or elements, of the first valve member may be configured to engage with corresponding sections, or elements, of the tubular body to hold and lock the first valve member in position relative to the tubular body. The further retaining member may be a non-releasable retaining member, or lock. The method may comprise the step of locking the first valve member when the first valve member is in the locked third intermediate configuration.

The first valve arrangement may include a piston device. The piston device may be operable to arrange the first valve arrangement in the first configuration, the second configuration, the first intermediate configuration, the second intermediate configuration, and the third intermediate configuration. The piston device may be operable to move the first valve member relative to the tubular body. The method may comprise the step of operating the piston device to arrange the first valve arrangement in the first configuration, the second configuration, the fourth configuration, the first intermediate configuration, the second intermediate configuration, and the third intermediate configuration.

The piston device may be a differential pressure piston device. The differential piston device may operate between a first operating surface area and a second operating surface area. The second operating surface area may be smaller than the first operating surface area. The first valve arrangement may define the piston device. The first valve arrangement may define the differential pressure piston device. The first valve arrangement may define a differential pressure piston.

The differential piston may be formed between the first valve member and the tubular body.

The differential pressure piston of the first valve arrangement may have a first operating surface which is exposed to an internal tubular body fluid pressure and a second operating surface which is subject to a biasing force from the biasing device. The biasing device may be located between the second operating surface, which is defined by the first valve member, and the tubular body. The biasing device may exert a biasing force on the second operating surface of the piston device. The biasing device may be operable to bias the first valve member to a position where the first port is closed. The method may comprise the step of operating the differential pressure piston device to arrange the first valve arrangement in the first configuration, the second configuration, the first intermediate configuration, the second intermediate configuration, and the third intermediate configuration. The method may comprise the step of operating the differential piston device by controlling the internal tubular body fluid pressure to arrange the first valve arrangement in the first configuration, the second configuration, the first intermediate configuration, the second intermediate configuration, and the third intermediate configuration.

The first valve arrangement may comprise one or more pressure balancing ports. The tubular body may comprise one or more pressure balancing ports. The pressure balancing ports may be provided in the wall of the tubular body. The pressure balancing ports may provide fluid communication between the inside and outside of the tubular body. The one or more pressure balancing ports may be associated with the differential pressure piston. The second operating surface of the differential pressure piston may be exposed to an external fluid pressure by the one or more pressure balancing ports, i.e., the second operating surface of the differential piston may be exposed to a fluid pressure between the tubular body and the well bore, such as annulus pressure. The second operating surface may therefore be subject to fluid pressure in the annulus between the tubular body and the well bore and a biasing force from the biasing device. The method may comprise the step of balancing the fluid pressure between the inside and outside of the tubular body. The method may comprise the step of balancing the fluid pressure between the inside and outside of the tubular body by controlling the internal tubular body fluid pressure. This step may be carried out in the initial configuration, where the downhole apparatus is run into the bore hole.

Operation of the first valve member may therefore be determined by the differential pressure between the first and second operating surfaces of the piston.

The first port may be configured to permit fluid to flow through the port in one direction and prevent fluid to flow through the port in an opposite direction. The first port may be configured to permit fluid to flow through the wall of the tubular body, from the inside of the tubular body to the outside of the tubular body. The method may comprise the step of communicating fluid through the first port.

The first port may include a check valve. The check valve may be configured to permit fluid to flow through the valve in one direction and prevent fluid to flow through the valve in an opposite direction. The check valve may be configured to permit fluid to flow through the port from the inside of the tubular body to the outside of the tubular body.

The first port may provide fluid communication with a tool or a device. The tool or device may be a downhole tool or device. The first port may provide fluid communication with a chamber. The chamber may be a deformable chamber. The chamber may be a fluid deformable chamber. The device may be a fluid deformable device. The fluid deformable device or chamber may provide support to a sand screen (sand control element). The fluid deformable device may be operable to activate the sand screen. The fluid deformable device or chamber may deform from a first deactivated state to a second activated state. The sand screen may be activated when the fluid deformable device or chamber is in the second activated state. The sand screen may be extended to a borehole wall when the fluid deformable device or chamber is in the second activated (fluid filled) state. The fluid deformable device or chamber may be mounted on the tubular body. The fluid deformable device or chamber may be mounted on an external surface of the tubular body. The method may comprise the step of communicating fluid through the first port to the tool, device, chamber or deformable chamber. The method may comprise the step of communicating fluid through the first port to activate and extend the sand screen to a borehole wall. The method may comprise the step of communicating fluid through the first port to activate the sand screen.

The first port may be an activation port.

The downhole apparatus may comprise a plurality of first ports. Each first port may be configured to permit fluid to flow through the port in one direction and prevent fluid to flow through the port in an opposite direction. Each first port may be configured to permit fluid to flow through the wall of the tubular body, from the inside of the tubular body to the outside of the tubular body. The method may comprise the step of communicating fluid through each first port.

Each first port may include a check valve. Each check valve may be configured to permit fluid to flow through the valve in one direction and prevent fluid to flow through the valve in an opposite direction. Each check valve may be configured to permit fluid to flow through the port from the inside of the tubular body to the outside of the tubular body.

Each first port may provide fluid communication with a tool or a device. The tool or device may be a downhole tool or device. Each first port may provide fluid communication with a chamber. The chamber may be a deformable chamber. The chamber may be a fluid deformable chamber. The device may be a fluid deformable device. The fluid deformable device or chamber may provide support to a sand screen (sand control element). The fluid deformable device may be operable to activate the sand screen. The fluid deformable device or chamber may deform from a first deactivated state to a second activated state. The sand screen may be activated when the fluid deformable device or chamber is in the second activated state. The fluid deformable device or chamber may be mounted on the tubular body. The fluid deformable device or chamber may be mounted on an external surface of the tubular body. The method may comprise the step of communicating fluid through each first port to the tool, device, chamber or deformable chamber. The method may comprise the step of communicating fluid through each first port to activate the sand screen.

The downhole tool or device may be a packer, hanger, sand screen, or bore wall-supporting device.

The second valve member may be operable to close the second port in the first configuration. The method may comprise the step of operating the second valve member to close the second port in the locked first configuration.

The second valve member may be operable to close the second port in the second configuration. The method may comprise the step of operating the second valve member to close the second port in the locked second configuration.

The second valve member may be operable to open the second port in the third configuration. The method may comprise the step of operating the second valve member to open the second port in the third configuration.

The second valve member may be operable to close the second port in the fourth configuration. The method may comprise the step of operating the second valve member to close the second port in the fourth configuration.

The second valve member may be a sleeve. The second valve member may be a sleeve member. The second valve member may be located within the tubular body.

The second valve member may include a first portion and a second portion. The first and second portions of the second valve member may be moveable with respect to one another. The first and second portions of the second valve member may be telescopically arranged. The first and second portions of the second valve member may be slidably arranged with respect to one another. The first portion of the second valve member may be configured to receive at least a portion of the second portion of the second valve member therein. The first and second portions of the second valve member may be releasably lockable with respect to one another. The first and second portions of the second valve member may be releasably lockable with respect to one another via one or more shear pins, screws, collets, collet fingers, ratchet rings, releasable ratchet rings, or the like. The method may include the step of operating the first and second portions of the second valve member. The method may include the step of releasably locking and unlocking the first and second portions of the second valve member together. The step of locking and unlocking may be repeatable.

The first and second portions of the second valve member may be releasably lockable with respect to one another by two separate releasable locking devices. A first locking device may be a retaining member, such as shear pins, screws, or the like, and a further locking device may be a retaining member, such as a retaining ring, ratchet ring, collets, collet fingers, body lock ring, snap latch, or the like. In this arrangement the first and second portions of the second valve member may be telescopically arranged with respect to one another. The further locking device may hold the second valve member in the locked fourth configuration. Sections, or elements, of the first portion of the second valve member may be configured to engage with corresponding sections, or elements, of the second portion of the second valve member to hold and lock the first and second portion together. The further locking device may be a non-releasable retaining member, or lock. The further locking device may be a releasable retaining member, or lock.

The downhole apparatus may further comprise a biasing device. The biasing device may be operable to apply a biasing force to the second valve member. The biasing device may be a spring member. The method may comprise the step of applying a biasing force to the second valve member.

The second valve member may be biased towards a position where the second port is open. The method may comprise the step of biasing the second valve member to a position where the second port is open.

The second valve arrangement may comprise one or more locking devices. The locking devices may be configured to lock the second valve member in place relative to the tubular body. The locking devices may be retaining members.

The locking devices may be releasable locking devices, or lock devices. The retaining members may be shear pins or screws, shear rings, or the like. The retaining members may be a plurality of shear pins or screws, shear rings, or the like.

The locking devices, or lock devices, may be ratchet rings, collets, collet fingers, body lock ring, snap latch, or the like. The second valve arrangement may comprise a ratchet ring locking device. The second valve arrangement may comprise one or more collets and collet fingers.

The second valve arrangement may comprise one or more primary retaining members. The primary retaining members may be releasable retaining members. The primary retaining members may be shear pins or screws, or the like. The primary retaining members may hold the second valve member in a first position relative to the tubular body. The primary retaining members may lock the second valve member relative to the tubular body. The primary retaining members may be associated with the first portion of the second valve member. In this configuration the second port may be closed.

The second valve arrangement may include a piston device. The piston device may be operable to arrange the second valve arrangement in the first configuration, the second configuration, the third configuration, the first intermediate configuration, the second intermediate configuration, the third intermediate configuration or the fourth intermediate configuration. The piston device may be operable to move the second valve member relative to the tubular body. The piston device may be operable to move the first portion of the second valve member relative to the tubular body. The method may comprise the step of operating the piston device to arrange the second valve arrangement in the first configuration, the second configuration, the third configuration, the first intermediate configuration, the second intermediate configuration, the third intermediate configuration or the fourth intermediate configuration.

The piston device may be a differential pressure piston device. The differential piston device may operate between a first operating surface area and a second operating surface area. The second operating surface area may be smaller than the first operating surface area. The second valve arrangement may define the piston device. The second valve arrangement may define the differential pressure piston device. The second valve arrangement may define a differential pressure piston. The differential piston may be formed between the second valve member and the tubular body.

The differential pressure piston of the second valve arrangement may have a first operating surface which is exposed to an internal tubular body fluid pressure and a second operating surface which is subject to a biasing force from the biasing device. The biasing device may be located between the second operating surface, which is defined by the second valve member, and the tubular body. The biasing device may exert a biasing force on the second operating surface of the further piston device. The biasing device may be operable to bias the second valve member to a position where the second port is open. The method may comprise the step of operating the differential pressure piston device to arrange the second valve arrangement in the first configuration, the second configuration, the third configuration, the first intermediate configuration, the second intermediate configuration, the third intermediate configuration or the fourth intermediate configuration.

The second valve arrangement may comprise one or more pressure balancing ports. The tubular body may comprise one or more pressure balancing ports. The pressure balancing ports may be provided in the wall of the tubular body. The pressure balancing ports may provide fluid communication between the inside and outside of the tubular body. The one or more pressure balancing ports may be associated with the differential piston. The second operating surface of the differential piston may be exposed to an external fluid pressure by the one or more pressure balancing ports, i.e., the second operating surface of the differential piston may be exposed to a fluid pressure between the tubular body and the well bore, such as annulus pressure. The second operating surface may therefore be subject to fluid pressure in the annulus between the tubular body and the well bore and a biasing force from the biasing device. The method may comprise the step of balancing the fluid pressure between the inside and outside of the tubular body. The method may comprise the step of balancing the fluid pressure between the inside and outside of the tubular body by controlling the internal tubular body fluid pressure. This step may be carried out in the initial configuration, where the downhole apparatus is run into the bore hole.

Operation of the second valve member may therefore be determined by the differential pressure between the first and second operating surfaces of the further piston.

The second port may provide fluid communication between the interior of the tubular body and the exterior of the tubular body. The fluid communication may be in either direction between the interior and exterior of the tubular body. The second port may be configured to permit flow of production fluid from a formation into the tubular body, and/or to permit treatment fluid to flow from the tubular body to the formation. The treatment fluid may pass through a sand filter to the formation. The method may comprise the step of communicating fluid through the second port.

The second port may include an inflow control device (ICD).

The second port may be a production port.

The second port may be provided in the second portion of the second valve member.

The downhole apparatus may comprise a plurality of second ports. Each second port may provide fluid communication between the interior of the tubular body and the exterior of the tubular body. The fluid communication may be in either direction between the interior and exterior of the tubular body. Each second port may be configured to permit flow of production fluid from a formation into the tubular body, and/or to permit treatment fluid to flow from the tubular body to the formation. The treatment fluid may pass through a sand filter to the formation. The method may comprise the step of communicating fluid through each second port.

Each second port may be provided in the second portion of the second valve member.

The tubular body may have a plurality of first and second ports in the wall thereof.

The downhole apparatus may comprise two or more first and second valve arrangements, each first and second valve arrangement being associated with a first port and a second port. Each first and second valve arrangement may be associated with a respective downhole tool or device. Each first and second valve arrangement may be associated with a respective packer, hanger, sand screen, or bore wall-supporting device. The method may comprise the step of operating each valve arrangement.

Each first and second valve arrangement of the downhole apparatus may be operated simultaneously. Each first and second valve arrangement of the downhole apparatus may be operated independently. Each first and second valve arrangement of the downhole apparatus may be operated sequentially. The method may comprise the step of operating each valve arrangement simultaneously, independently or sequentially.

Embodiments of the second aspect of the present invention may include one or more features of the first aspect of the present invention or their embodiments. Embodiments of the third aspect of the present invention may include one or more features of the first or second aspects of the present invention or their embodiments. Embodiments of the fourth aspect of the present invention may include one or more features of the first, second or third aspects of the present invention or their embodiments. Embodiments of the fifth aspect of the present invention may include one or more features of the first, second, third or fourth aspects of the present invention or their embodiments. Embodiments of the sixth aspect of the present invention may include one or more features of the first, second, third, fourth or fifth aspects of the present invention or their embodiments. Embodiments of the seventh aspect of the present invention may include one or more features of the first, second, third, fourth, fifth or sixth aspects of the present invention or their embodiments.

BRIEF DESCRIPTION OF THE DRAWINGS

Embodiments of the invention will now be described, by way of example, with reference to the drawings, in which.

DESCRIPTION

Figure 1:
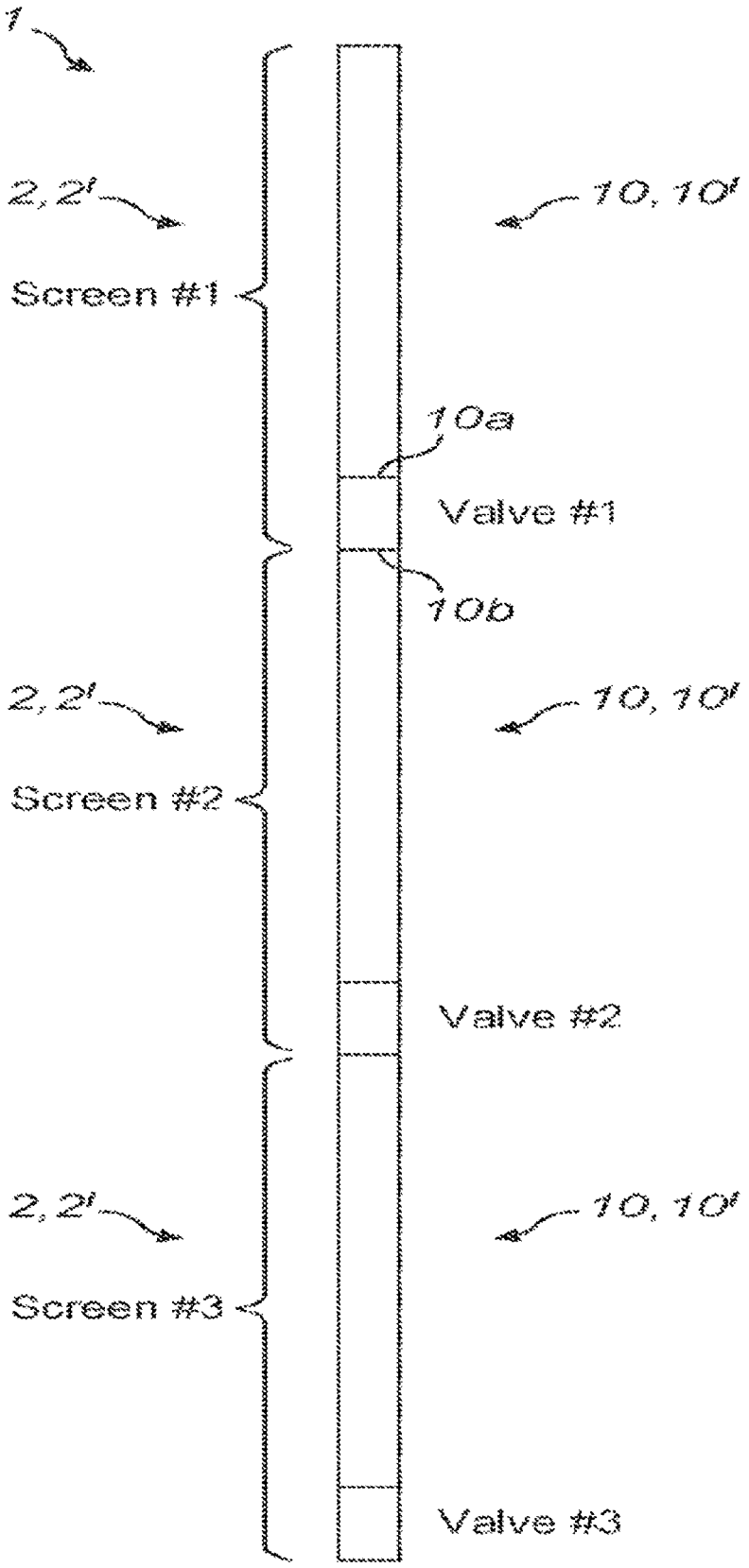
FIG. 1 is a schematic illustration of a portion of a well completion including three downhole apparatus of the present invention.

With reference to FIG. 1, a portion of a well completion 1 is illustrated that comprises three downhole apparatus 10 according to an embodiment of the present invention. The well completion 1 includes sand screens 2 (sand control elements), each sand screen 2 being associated with a downhole apparatus 10. It should be appreciated that the portion of the well completion 1 illustrated in FIG. 1 may include other elements and components usually associated with a well completion, such as packers, zonal isolations, hangers, valves, a leading shoe, and the like. The number of downhole apparatus 10 and sand screens 2 can be varied as required by the application and user requirements. The downhole apparatus 10 has an upper end 10*a* lower end 10*b*.

As described below, the downhole apparatus 10 and sand screens 2 are run into the wellbore/subterranean formation with the sand screens 2 in a deactivated (retracted) configuration and then subsequently activated to assume a larger diameter configuration. In the activated configuration the outer surface of the sand screens 2 engage with the bore wall to provide support thereto.

Figure 2A:
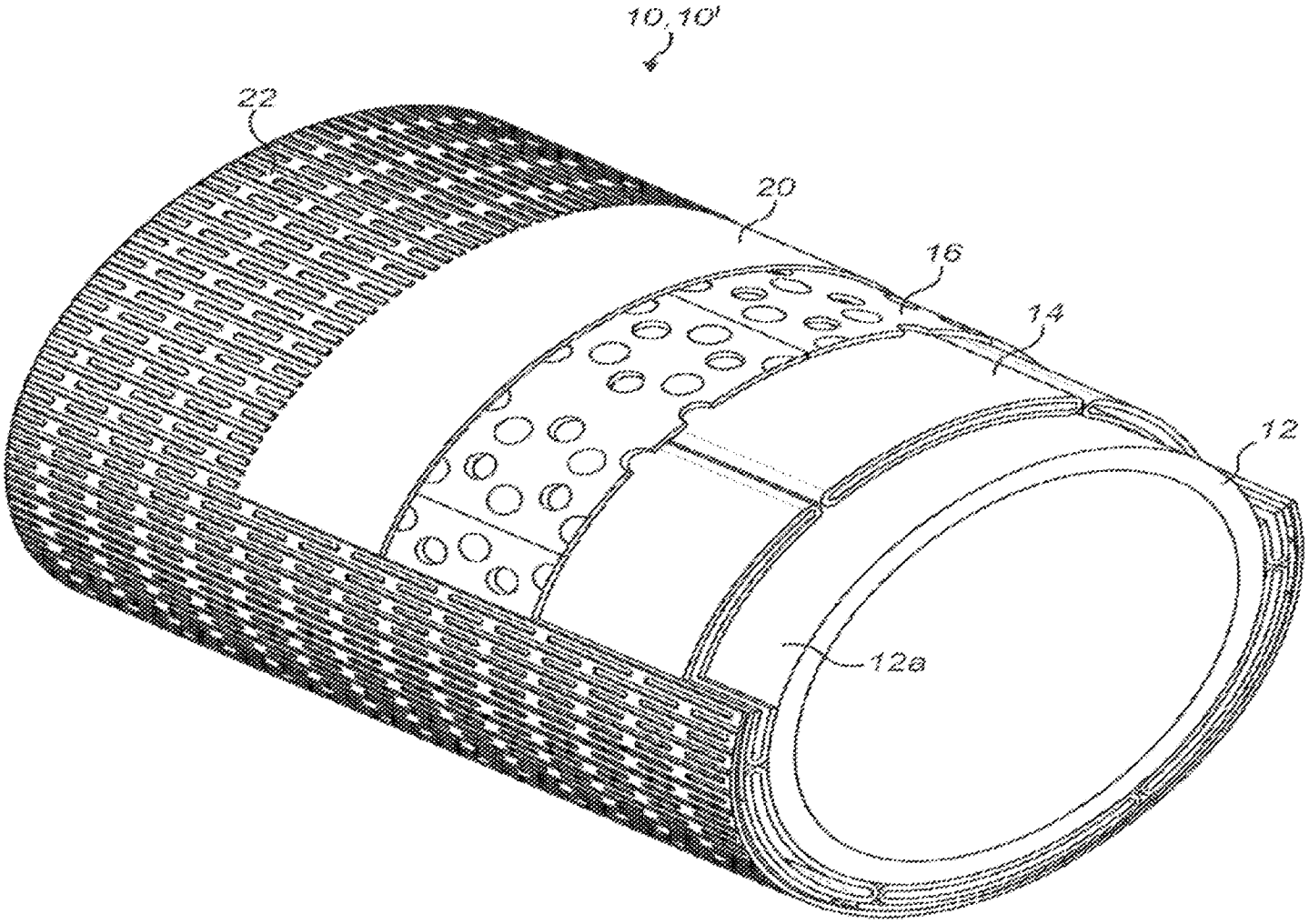
FIG. 2*a* is a partial cut-away perspective view of part of a downhole apparatus of FIG. 1, where the activatable chambers are deactivated.
Figure 2B:
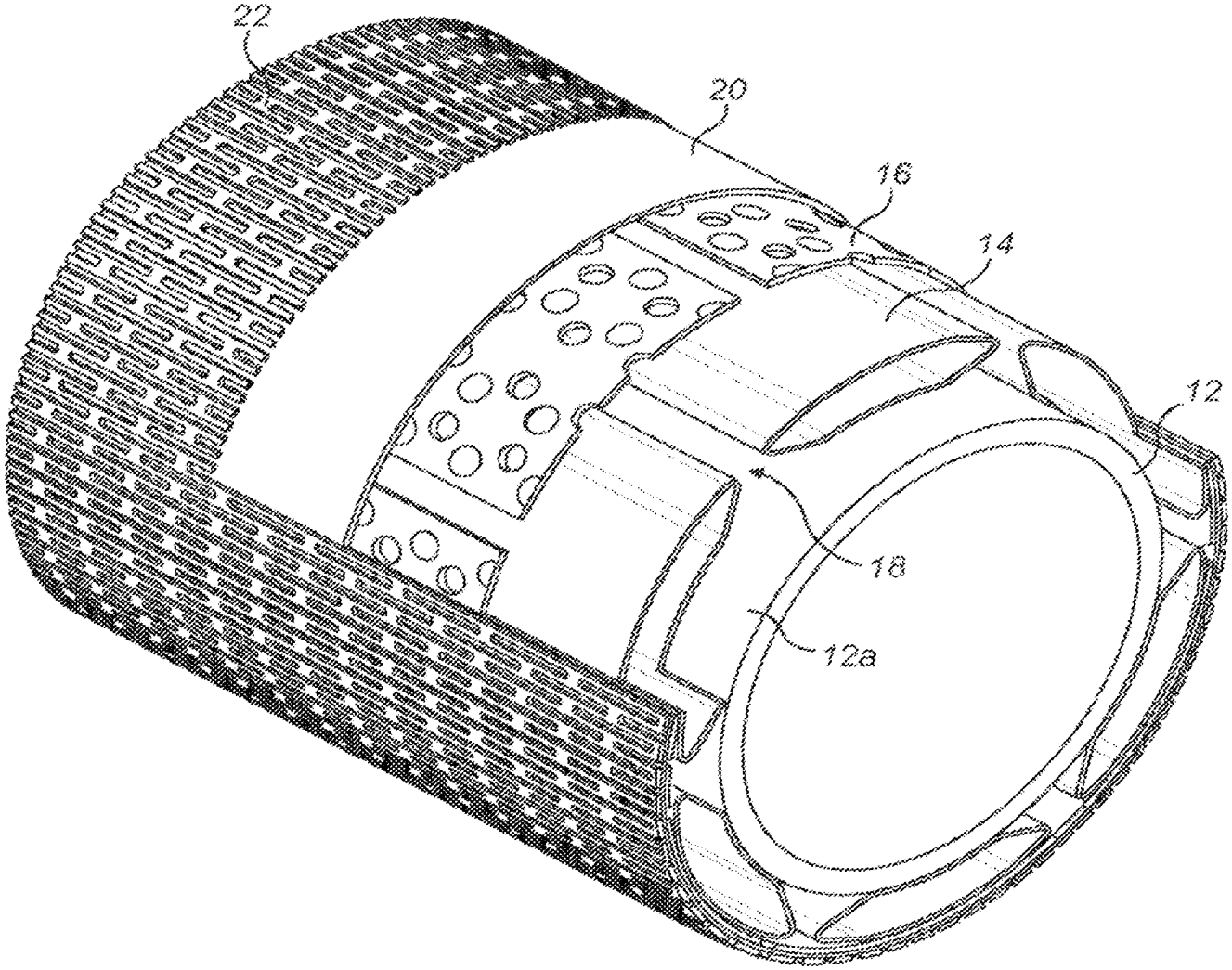
FIG. 2*b* illustrates the activatable chambers of FIG. 2*a* in an activated state.

FIG. 2*a* illustrates a partial cut-away perspective view of part of the downhole apparatus 10 in an initial deactivated state. The apparatus 10 includes a base pipe 12, onto which are mounted six activation chambers 14. The activation chambers 14 extend longitudinally along the outer circumferential surface 12*a* of the base pipe 12. The chambers 14 are laterally spaced from one another around the outer circumferential surface 12*a* of the base pipe 12. As illustrated in FIG. 2*b*, the chambers 14 are operable to be activated, or deformed, by filling the chambers 14 with high pressure fluid, such that the chambers 14 assume an activated state.

The apparatus 10 includes a drainage layer 16 located on top of the chambers 14. The drainage layer 16 is an aperture sheet that extends longitudinally along the base pipe 12. The drainage layer 16 is rotationally offset relative to the chambers 14, such that when the chambers 14 are activated the drainage layer 16 bridges gaps 18 between the chambers 14.

The drainage layer 16 supports a filter 20. The filter 20 may be a weave. A protective shroud 22 is provided over the filter 20.

Single Valve Arrangement

With reference to FIGS. 3*a* to 3*e*, a downhole apparatus 10 is illustrated in various configurations of use. As will be described further below, the main components of the downhole apparatus 10 are a tubular body 24, a valve arrangement 26, activation chambers 14 and components of the sand screen 2, as described above.

In addition to the above components, the downhole apparatus 10 also comprises: a valve joint section 28, which may be used to connect the lower end of the valve arrangement 26 to the upper end of an adjacent valve arrangement/sand screen section, or a bull nose end seal, if the valve arrangement 26 is the last valve arrangement of the apparatus; and a screen joint section 30 (which may also be the base pipe 12), which may be used to connect the upper end of the valve arrangement 26 (sand screen) (tubular body 24) to the lower end of an adjacent valve arrangement. The valve joint section 28 is attached to a cross-over section 32 (an example of a connection member, or a valve joint section connection member), which is attached to the tubular body 24. As described further below, the cross-over section 32 provides a retaining member for locking of the valve arrangement 26.

The tubular body 24 is a generally cylindrical member that defines a first port 24*a* and a second port 24*b*. The tubular body comprises a first portion 24*c* and a second portion 24*d*. The first portion 24*c* is an upper portion and the second portion is a lower portion 24*d*. The tubular body 24 also includes a valve clamp body 25 which connects the first and second portions 24*c*, 24*d* of the tubular body 24 together.

First and second ports 24*a* and 24*b* are apertures in the wall of the tubular body 24. In the embodiment illustrated and described here the tubular body 24 includes a plurality of first and second ports 24*a*, 24*b* circumferentially arranged around the tubular body 24.

The valve arrangement 26 is located towards the lower end 10*b* of the apparatus 10. In the embodiment illustrated and described here the valve arrangement 26 is a single valve and has an upper end 26*a* and a lower end 26*b*. The valve arrangement 26 includes a valve member 26*c*. The valve member 26*c* has an upper end 26*h* and a lower end 26*i*. The valve member 26*c* is a generally cylindrical member that includes a first port 26*d* and a second port 26*e* in the wall thereof. The first and second ports 26*d*, 26*e* are apertures in the wall. The valve member 26*c* includes a plurality of first and second ports 26*d*, 26*e* circumferentially arranged around the valve member 26*c*. Each first and second port 26*d*, 26*e* includes a sealing member 26*f*, 26*g* positioned on either side of the first and second ports 26*d*, 26*e*. The seals 26*f*, 26*g* are configured to provide a seal between the first and second ports 26*d*, 26*e* of the valve member 26*c* and the tubular body 24, such that the first and second ports 24*a*, 24*b* of the tubular body 24 may be sealed when pressurised fluid is being passed through the ports, or isolated when fluid is not being passed through the ports.

As described further below, the first port 26*d* of the valve member 26*c* is associated with the first port 24*a* of the first portion 24*c* of the tubular body 24 and the second port 26*e* of the valve member 26*c* is associated with the second port 24*b* of the first portion 24*c* of the tubular body 24, and the valve member 26*c* is moveable with respect to the tubular body 24. The valve member 26*c* is a sleeve member and is configured to slide within the tubular body 24 to open and/or close the first and second ports 24*a*, 24*b* of the tubular body 24. As described further below, the valve arrangement 26 is configurable to control the flow of fluid through the first and second ports 24*a*, 24*b* of the tubular body 24.

The first ports 24*a* of the first portion 24*c* of the tubular body 24 are activation ports and are arranged to provide fluid communication with the activation chambers 14. As described further below, fluid pressure within the tubular body 24 may be communicated to the chambers 14 through the first ports 24*a* via operation of the valve member 26*c*. Each first port 24*a* includes a check valve 24*e* that is arranged to permit fluid flow through the port 24*a* (and valve arrangement 26) in one direction and to prevent fluid to flow through the port 24*a* (and valve arrangement 26) in an opposite direction. The check valve 24*e*, and hence the first port 24*a*, is configured to permit fluid to flow through the first port 24*a* from the inside of the tubular body 24 to the chamber 14. In this configuration, the chambers 14, once activated, remain activated. As described above, activation of the chambers 14 activates the sand screens 2. The sand screens 2 therefore also remain activated once the chambers 14 have been activated.

The second ports 24*b* of the tubular body 24 are production ports and are arranged to provide fluid communication between the interior of the tubular body 24 and the exterior of the tubular body 24. As described further below, the second ports 24*b* are configured to permit flow of production fluid, such as oil and gas, from a wellbore formation into the tubular body, and/or to permit treatment fluid to flow from the tubular body 24 to the wellbore formation. The treatment fluid may pass through a sand filter to the formation.

Each second port 24*b* may include an inflow control device (ICD) 34.

The downhole apparatus 10 also comprises a spring member 36 (an example of a biasing device) located between the valve member 26*c* and the second portion 24*d* of the tubular body 24. The spring member 36 is configured to apply a biasing force to the valve member 26*c* to bias the valve member 26*c* to a position where the second port 24*b* is open.

Figure 3A:
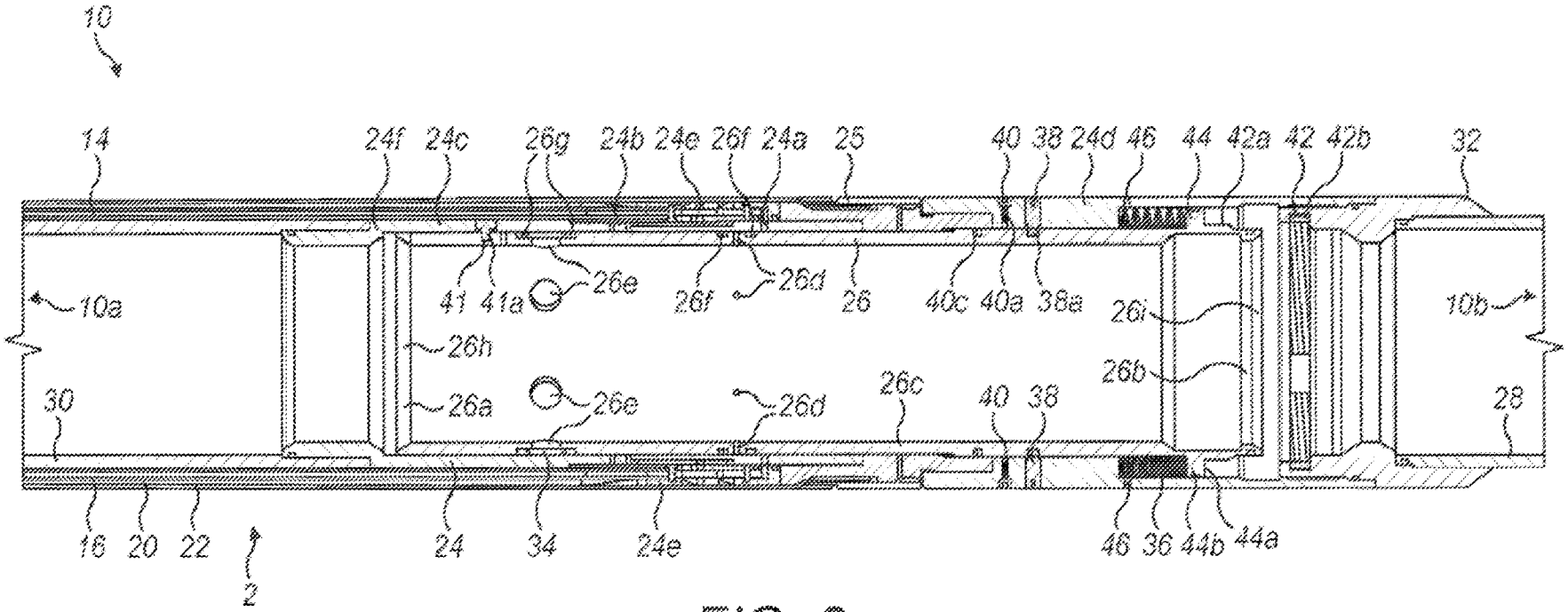
FIGS. 3*a* to 3*e* are sectional side views of a first embodiment of a downhole apparatus of the present invention in a locked first configuration (initial configuration), a first intermediate configuration, a locked second configuration, a second intermediate configuration and a third configuration, respectively.

The valve arrangement 26 also comprises a plurality of primary retaining members 38 (an example of one or more locking devices). As illustrated in FIG. 3*a*, the primary retaining members 38 are configured to lock the valve member 26*c* in position relative to the tubular body 24. In the embodiment illustrated and described here the primary retaining members 38 are shear screws. The primary retaining members 38 are therefore releasable retaining members. The retaining members 38 may be configured to lock in grooves 38*a* in the valve member 26*c*.

The valve arrangement 26 also comprises a plurality of secondary retaining members 40 (an example of one or more locking devices). As illustrated in FIG. 3*a*, the secondary retaining members 40 are configured to lock the valve member 26*c* in position relative to the tubular body 24. The retaining members may be configured to lock in grooves 40*c* in the valve member 26*c*. In the embodiment illustrated and described here the secondary retaining members 40 are shear screws. The secondary retaining members 40 are therefore releasable retaining members.

In the configuration illustrated in FIG. 3*a*, the primary retaining members 38 are engaged with the valve member 26*c* to hold the valve member in the locked position and the second retaining members 40 are disengaged from the valve member 26*c*. In the configuration illustrated in FIG. 3*c*, the primary retaining members 38 are disengaged from the valve member 26*c* and the second retaining members 40 are engaged with the valve member 26*c* to hold the valve member 26*c* in the locked position. The second retaining members 40 are biased towards the valve member 26*c*. The second retaining members 40 are biased towards the valve member 26*c* by a spring member 40*a*.

The valve arrangement 26 also comprises a further retaining member 42 (an example of one or more locking devices). The further retaining member 42 is a ratchet ring 42*b* (ratchet snap ring) that is located within the cross-over section 32. The retaining member 42 is configured to lock the valve member 26*c* in position relative to the tubular body. The retaining member 42 is configured to receive and engage with a complimentary-shaped portion, or profile, of the valve member 26*c*. The ratchet ring 42*b* of the retaining member 42 is configured to receive and engage with a complimentary ratchet profile 42*a* of the lower end 26*b* of the valve member 26. The ratchet ring 42*b* may be a shear ring, such that the retaining member 42 may be released via mechanical override, mechanical actuation. The retaining member 42 may therefore be releasable.

The valve arrangement 26 also comprises a timing pin 41. The timing pin 41 is mounted in the first portion 24*c* of the tubular body 24 and is configured to engage with a timing pin slot 41*a* in the valve member 26*c*. The timing pin 41 and timing pin slot 41*a* are configured to prevent rotation of the valve member 26*c* relative to the tubular body 24 during use. The timing pin 41 and timing pin slot 41*a* are also configured to ensure alignment of the first port 24*a* and a second port 24*b* of the tubular body 24 with the first port 26*d* and a second port 26*e* of the valve member 26*c*.

The valve arrangement 26 also includes a piston device 44. The piston device 44 is a differential pressure piston. The piston device 44 is operable to arrange the valve arrangement 26 in various configurations, as described further below. The piston device 44 is operable to move the valve member 26*c* relative to the tubular body 24. The valve arrangement 26 defines the differential piston device 44. The differential piston device 44 being arranged between the lower end 26*i* of the valve member 26*c* and the second portion 24*d* of the tubular body 24. The piston device 44 has a first operating surface 44*a*, which may be exposed to a fluid pressure within the tubular body 24, and a second operating surface 44*b*, which is subject to a biasing force from the spring member 36 (an example of a biasing device). The differential piston device 44 operates between a first operating seal diameter (first operating surface 44*a*) and a second (smaller) operating seal diameter (created by sealing member 260. The spring member 36 is located between the second operating surface 44*b* and the second portion 24*d* of the tubular body 24. As described above, the spring member 36 is operable to bias the valve member 26 to a position where the second port 24*b* is open.

The valve arrangement 26 also comprises pressure balancing ports 46. The pressure balancing ports 46 are associated with the differential piston device 44. The pressure balancing ports 46 are provided in the wall of the second portion 24*d* of the tubular body 24 and provide fluid communication between the inside and outside of the tubular body 24. The second operating surface 44*b* of the differential piston 44 is exposed to an external fluid pressure by the pressure balancing ports 46, i.e., the second operating surface 44*b* of the differential piston is exposed to a fluid pressure between the tubular body 24 and the well bore, such as annulus pressure. The second operating surface 44*b* may therefore be subject to fluid pressure in the annulus between the tubular body 24 and the well bore and a biasing force from the spring member 36.

In the embodiment illustrated and described here the valve arrangement 26 is therefore a fluid pressure-responsive valve arrangement. The valve arrangement 26 being hydraulically-operable via pressurised fluid applied to the apparatus 10.

Operation of Single Valve Arrangement

The operation of the valve arrangement 26 and activation of the chambers 14 will now be described with reference to FIGS. 3*a* to 3*e* and 6*a*.

The valve arrangement 26 may have a locked first configuration, in which the first port 24*a* is closed and the second port 24*b* is closed; a locked second configuration, in which the first port 24*a* is open and the second port 24*b* is closed; and a third configuration, in which the first port 24*a* is closed and the second port 24*b* is open.

Locked 1$^{st}$ Configuration

FIG. 3*a* (Point A—FIG. 6*a*) illustrates the locked first configuration of the valve arrangement 26, in which both the first ports 24*a* and the second ports 24*b* are closed. This configuration may be an initial configuration of the valve arrangement 26 and may be the configuration in which the downhole apparatus 10 is entered (or run in (RIM) to a borehole of a well. During run in, the pressure balancing ports 46 allow the apparatus 10 to be pressure-balanced during deployment. This configuration also allows for a wash down and/or circulation of filter cake treatment to take place prior to activation of the sand screens 2. Note that circulation of fluid on run in requires an open end, i.e., the lowermost end of the completion must be open. The system circulation flow path is closed before pressurised fluid is applied to the apparatus 10.

As illustrated in FIG. 3*a*, the valve member 26*c* is locked in position relative to the tubular body 24 by the primary retaining members 38. In this position the secondary retaining members 40 are disengaged from the valve member 26*c*, the ratchet profile 42*a* of the valve member 26*c* is disengaged from the ratchet ring 42*b* of the further retaining member 42, the upper end 26*h* of the valve member 26*c* is spaced from a shoulder portion 24*f* of the first portion 24*c* of the tubular body 24 and the spring member 36 is partially compressed. The chambers 14 are also in an inactive (deflated) state. The deactivated chambers 14 are illustrated in FIG. 3*a*. This corresponds to FIG. 2*a*.

Once the lowermost end of the apparatus 10 is closed, there is initially no pressurised fluid inside the tubular body 24 (this may be an example of a first fluid pressure). This is illustrated at point A in FIG. 6*a* at the RIH position. As described below, once pressurised fluid is applied to the apparatus 10, the chambers 14 are isolated from this pressure.

Figure 6A:
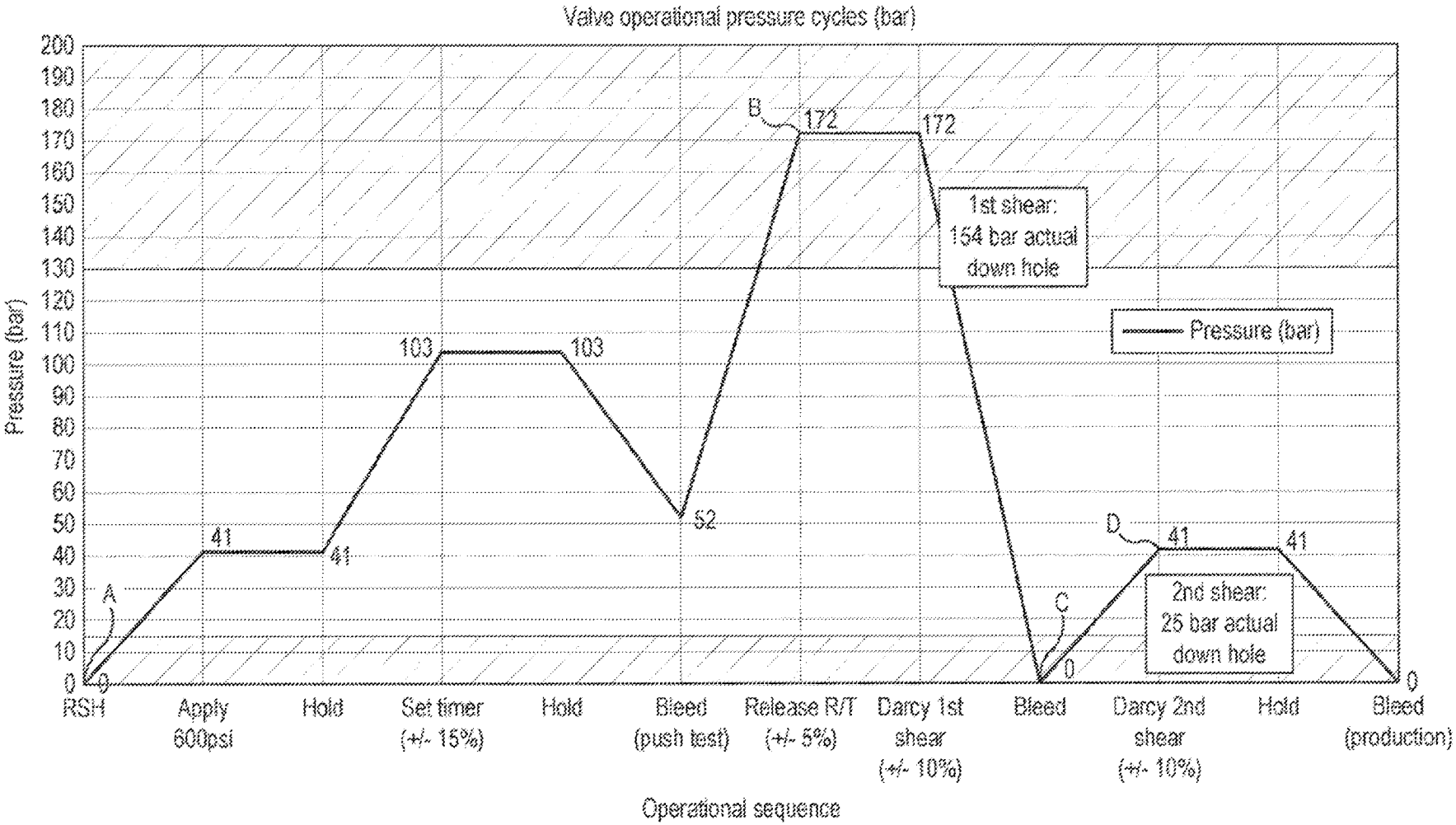
FIG. 6*a* is a graph detailing the pressure cycle of the downhole apparatus of FIGS. 3*a* to 3*e* during operation.

The valve arrangement 26 is now moved to a first intermediate configuration (Point B—FIG. 6*a*).

$1^{st}$ Intermediate Configuration

Figure 3B:
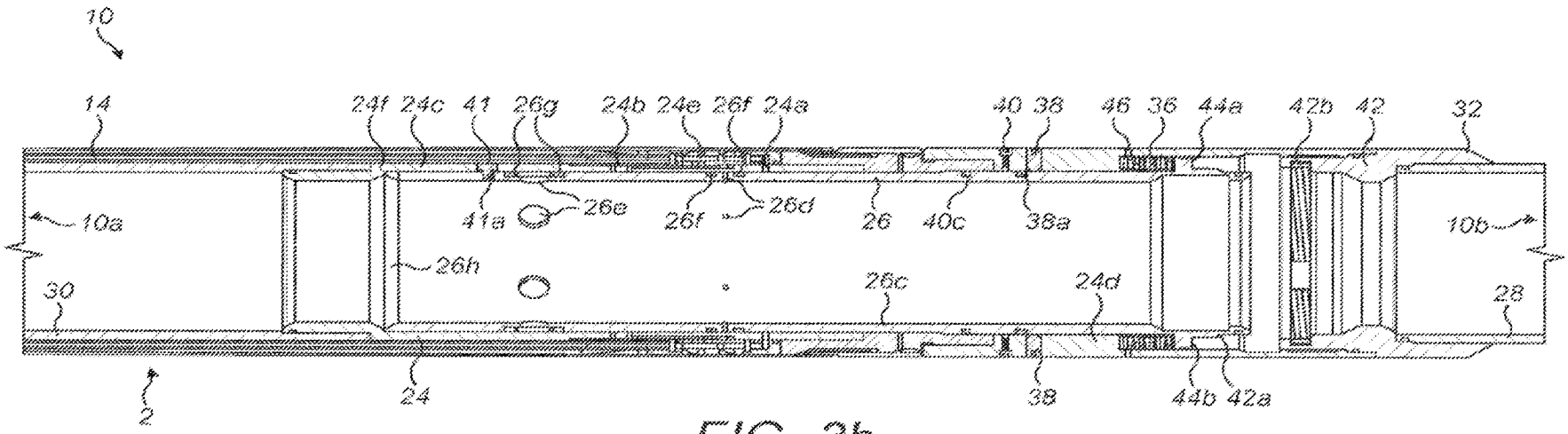

FIG. 3*b* (Point B—FIG. 6*a*) illustrates a first intermediate configuration of the valve arrangement 26, in which the valve arrangement 26 is unlocked and the first ports 24*a* and the second ports 24*b* are closed.

With the lowermost end of the apparatus 10 closed, the inside of the tubular body 24 is pressurised with fluid from the surface from a fluid pressure generation device, or the like. In the embodiment described here and illustrated in FIG. 6*a*, the pressure is initially increased to 600 psi (approx. 41 bar) (this may be an example of a first fluid pressure) and held for a period of time before being raised to 1500 psi (approx. 103 bar) (this may be an example of a first fluid pressure) to allow a liner to bet set. The pressure is held at this pressure for a period of time before being reduced (bled off) to 750 psi (approx. 52 bar). The pressure is then increased to 2500 psi (approx. 172 bar) (this is an example of a second fluid pressure).

Increasing the pressure to 2500 psi moves the valve member 26*c* upwards and causes the primary retaining members 38 to be released (sheared). This is effected by applying a greater force to the first operating surface 44*a* than the second operating surface 44*b* of the differential piston device 44. That is, the primary retaining members 38 are sheared due to the pressure differential created by different piston areas acting in opposing directions. The primary retaining members 38 are sheared due to the force difference created between the first operating seal (large diameter) (first operating surface 44*a*) and the second (smaller) diameter operating seal (created by sealing member 26*f*). For example, the seal at the first operating surface 44*a* has an area of approximately 40 $in^2$ (approximately 258 $cm^2$) and the seal at sealing member 26*f* has an area of approximately 28 $in^2$ (approximately 181 $cm^2$). This means when pressure is applied, there is a net 12 $in^2$ (77 $cm^2$) piston area acting to shear the retaining members 38, i.e. 100 psi applied equates to 1,200 lbs force acting to shear the retaining members 38 and compress the spring 46.

In this position the secondary retaining members 40 are disengaged from the valve member 26*c*, the ratchet profile 42*a* of the valve member 26*c* is disengaged from the ratchet ring 42*b* of the further retaining member 42, the upper end 26*h* of the valve member 26 abuts against the shoulder portion 24*f* of the first portion 24*c* of the tubular body 24 and the spring member 36 is further compressed. The chambers 14 are also in an inactive (deflated) state and remain isolated from the internal pressurised fluid in the tubular body 24. This operation may be termed the primary shear ($1^{st}$ shear).

The valve arrangement 26 is now moved to the locked second configuration (Point C—FIG. 6*a*).

Locked $2^{nd}$ Configuration

Figure 3C:
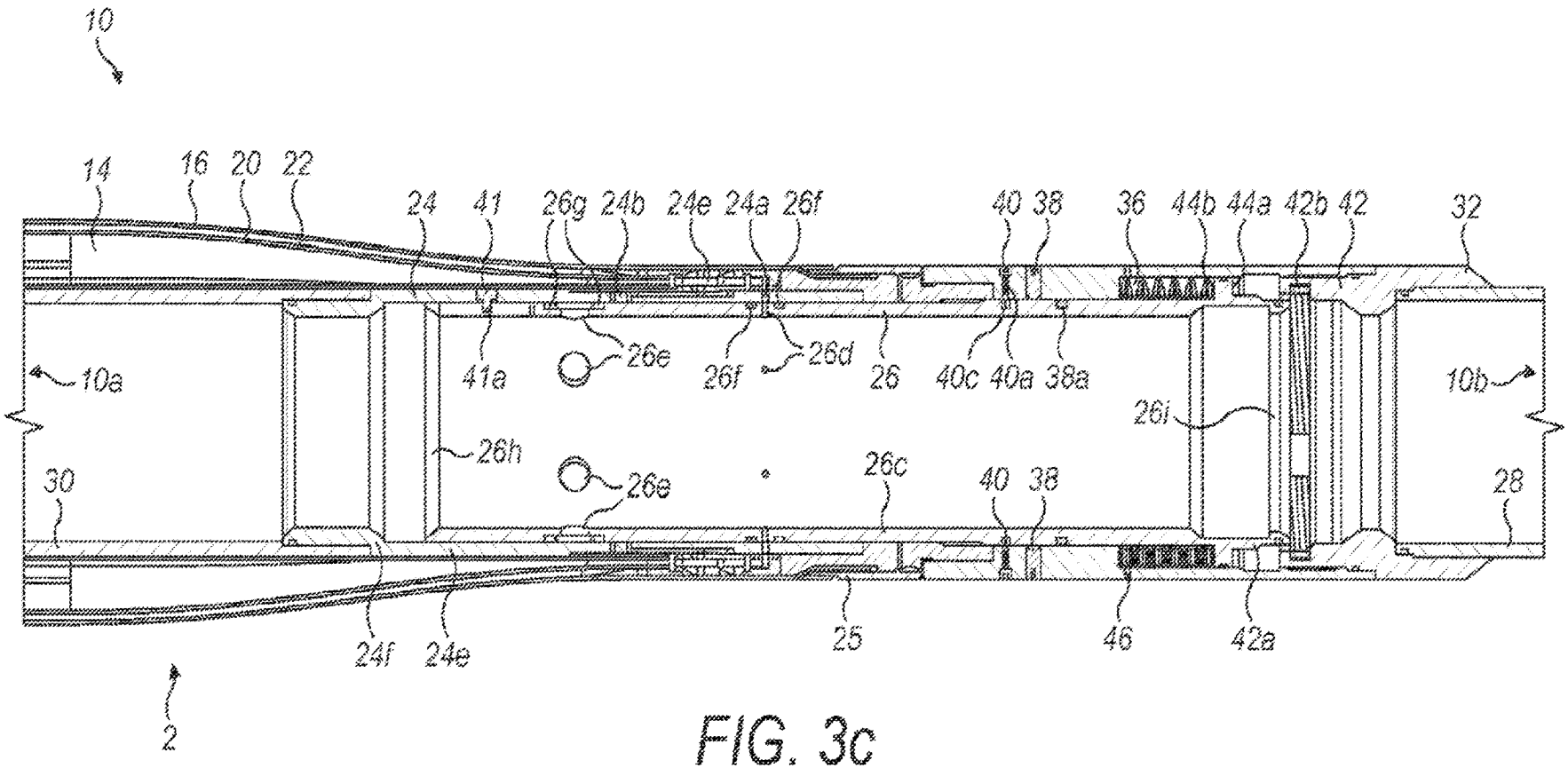

FIG. 3*c* (Point C—FIG. 6*a*) illustrates the locked second configuration of the valve arrangement 26, in which the first ports 24*a* are open and the second ports 24*b* are closed.

To move the valve arrangement 26 from the first intermediate configuration to the second locked configuration the fluid pressure in the tubular body 24 is reduced (bled off). As illustrated in FIG. 6*a*, the fluid pressure is reduced from 2500 psi to approx. 0 psi (this is an example of a third fluid pressure). With the valve member locked inadvertent activation of the screen is prevented.

Decreasing the pressure towards 0 psi causes the valve member 26*c* to move downwards and the secondary retaining members 40 to engage with the valve member 26*c*. That is, as the pressure is bled off, the spring member 36 applies a greater force than the differential pressure across the differential piston device 44.

As described above, the secondary retaining members 40 are spring biased towards the valve member 26*c*. In this position the valve member 26*c* is locked relative to the tubular body 24 and the first ports 24*a* are open. The chambers 14 are also in an inactive (deflated) state but are no longer isolated from the internal pressurised fluid in the tubular body 24. As illustrated in FIG. 3*c*, the first ports 24*a* are aligned with the first ports 26*d* of the valve member 26*c*.

In this configuration the chambers 14 may now be activated by filling them with pressurised fluid from the tubular body 24. Pressurised fluid is passed through the first ports 26*d* of the valve member 26*c*, the first ports 24*a* of the tubular body 24 and through the one way check valves 24*e* to activate the chambers 14. The activated chambers 14 are illustrated in FIG. 3*c*. This corresponds to FIG. 2*b*.

In this position the ratchet profile 42*b* of the ratchet profile 42*a* of the valve member 26*c* is disengaged from the ratchet ring 42 of the further retaining member 42, the upper end 26*h* of the valve member 26 is spaced from the shoulder portion 24*f* of the first portion 24*c* of the tubular body 24 and the spring member 36 is extended. This operation may be termed the activation state.

As illustrated in FIG. 6*a*, the fluid pressure is increased towards 600 psi (approx. 41 bar). The chambers 14 may fully activate at a lower pressure than 600 psi, such as 400 psi. This ensures that all the chambers 14 are activated.

Increasing the fluid pressure towards 600 psi moves the valve arrangement 26 towards a second intermediate configuration (Point D—FIG. 6*a*).

$2^{nd}$ Intermediate Configuration

Figure 3D:
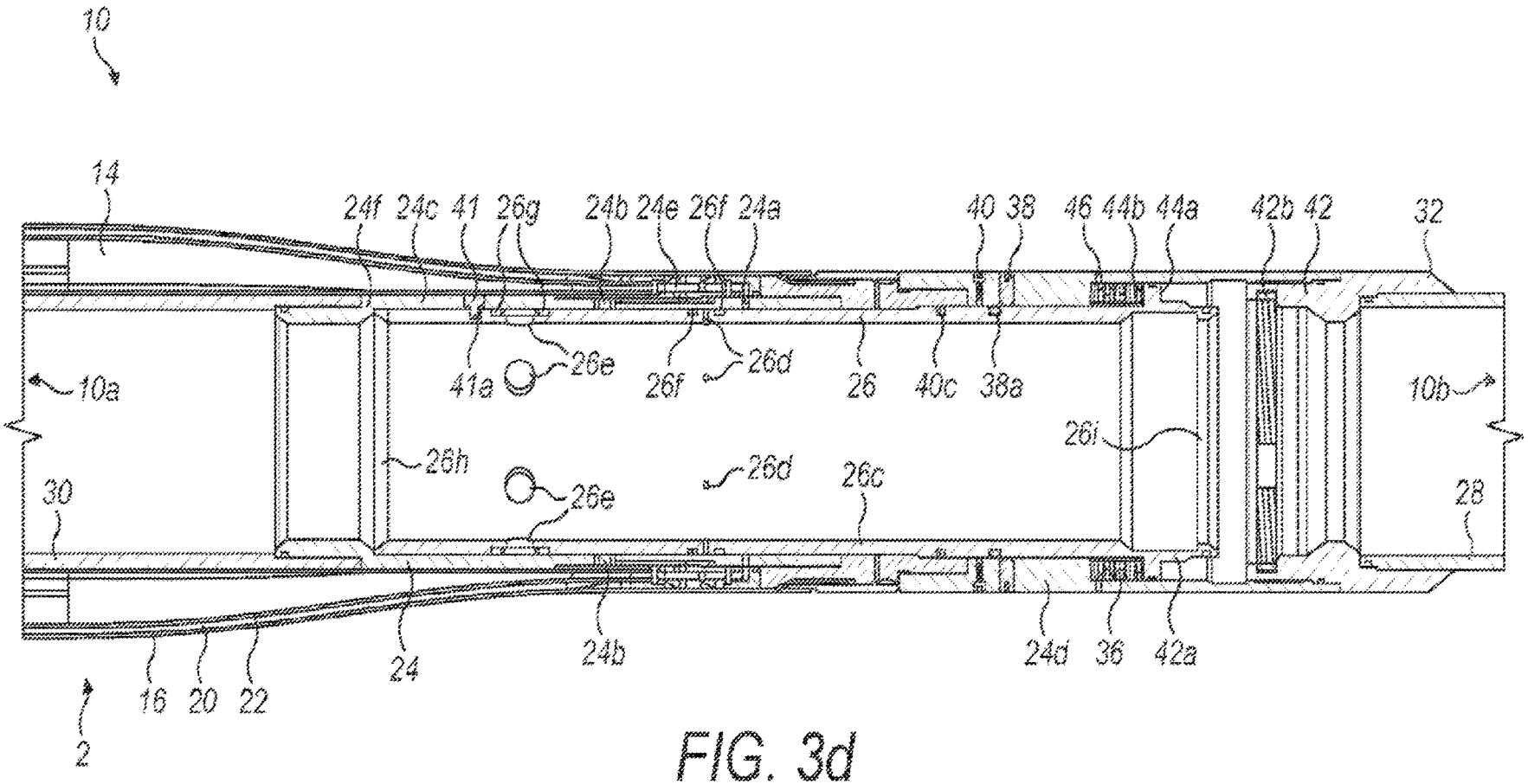

FIG. 3*d* (Point D—FIG. 6*a*) illustrates a second intermediate configuration of the valve arrangement 26, in which the valve arrangement 26 is unlocked and the first ports 24*a* and the second ports 24*b* are closed.

Increasing the fluid pressure towards 600 psi (this is an example of a fourth fluid pressure) moves the valve member 26*c* upwards and causes the secondary retaining members 40 to be released (sheared). This is effected by applying a greater force to the first operating surface 44*a* than the second operating surface 44*b* of the differential piston device 44. That is, the secondary retaining members 40 are sheared due to the pressure differential created by different piston areas acting in opposing directions. The secondary retaining members 40 are sheared due to the force difference created between the first operating seal (large diameter) (first operating surface 44*a*) and the second (smaller) diameter operating seal (created by sealing member 260.

As illustrated in FIG. 6*a*, the fluid pressure is held at 600 psi for a period of time. This ensures that all retaining members 40 are sheared. This pre-sets the final pressure in the chambers 14. This means that the retaining members set the activation pressure.

In this position the ratchet profile 42*a* of the valve member 26*c* is disengaged from the ratchet ring 42*b* of the further retaining member 42, the upper end 26*h* of the valve member 26*c* abuts against the shoulder portion 24*f* of the first portion 24*c* of the tubular body 24 and the spring member 36 is further compressed. The chambers 14 are also in an activated state and are isolated from the internal pressurised fluid in the tubular body 24. Pressurised fluid is thus locked into each of the chambers 14 by the individual check valves 24*e*. This operation may be termed the secondary shear.

The valve arrangement 26 is now moved to the third configuration (Point E—FIG. 6*a*).

3rd Configuration

Figure 3E:
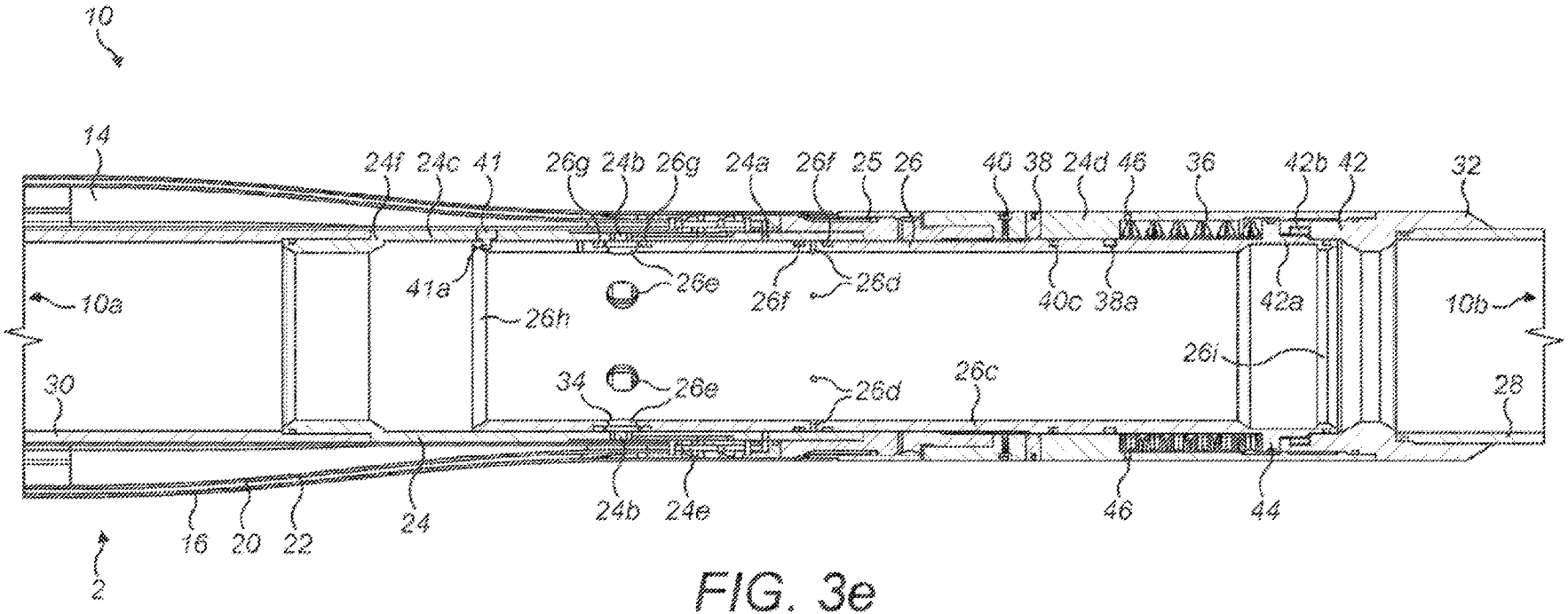

FIG. 3*e* (Point E—FIG. 6*a*) illustrates a locked third configuration of the valve arrangement 26, in which the first ports 24*a* are closed and the second ports 24*b* are open.

To move the valve arrangement 26 from the second intermediate configuration to the locked third configuration the fluid pressure in the tubular body 24 is reduced (bled off). As illustrated in FIG. 6*a*, the fluid pressure is reduced from 600 psi to approx. 0 psi.

Decreasing the pressure towards 0 psi causes the valve member 26*c* to move downwards and the valve member 26*c* to engage with the retaining member 42. This is effected by the spring member 36 applying a greater force to the second operating surface 44*b* than the differential fluid pressure acting across the areas of the differential piston device 44.

In this position the valve member 26*c* is locked relative to the tubular body 24 and the second ports 24*b* are open. The chambers 14 are also in an activated state and are isolated from the internal pressurised fluid in the tubular body 24. As illustrated in FIG. 3*e*, the second ports 24*b* are aligned with the second ports 26*e* of the valve member 26*c*.

In this configuration fluid communication can occur between the formation (reservoir), the tubular body 24 and the surface. Production fluid may now pass from the formation through the second ports 24*b* and into the tubular body 24.

In this position the ratchet profile 42*a* of the valve member 26*c* is engaged with the ratchet ring 42*b* of the further retaining member 42, the upper end 26*h* of the valve member 26*c* is spaced from the shoulder portion 24*f* of the first portion 24*c* of the tubular body 24 and the spring member 36 is extended. In this configuration the differential piston 44 is also unseated, to remove any residual pressure acting thereon. This operation may be termed the production state.

4th Locked Configuration

The valve arrangement 26 may also have a locked fourth configuration, in which the valve member 26*c* is locked and the first and second ports 24*a*, 24*b* are closed. The locked fourth configuration may be achieved after the third configuration. The locked fourth configuration of the valve arrangement 26 is one where the valve arrangement 26 is moved from a production position to a shut-off position. The fourth configuration may be achieved by mechanical intervention, e.g., by using a shifting tool to mechanically move the valve member 26*c* to a position where the first and second ports 24*a*, 24*b* are closed and the valve member 26*c* is locked relative to the tubular body 24. The valve member 26*c* may be locked with a suitable retaining member of lock device, such as a collet, ratchet ring etc. The locking device may be releasable. In the embodiment illustrated and described here a shifting tool may move the valve upwards and lock the valve member 26*c* relative to the tubular body 24 with the first and second ports 24*a*, 24*b* closed.

Dual Valve Arrangement

With reference to FIGS. 4*a* to 5*e*, an alternative embodiment of the downhole apparatus 10 is illustrated in various configurations of use. The main difference between the downhole apparatus 10 of the first embodiment to the downhole apparatus 10' of the second embodiment is that the downhole apparatus 10' of the second embodiment has a dual valve arrangement 26', as opposed to the single valve arrangement 26 of the first embodiment. Other than the operation of the valve arrangement 26', the general operation of the downhole apparatuses 10 and 10' are the same. This includes the operation of the chambers 14, 14' and sand screens 2, 2'.

With reference to FIGS. 4*a* to 5*e*, a downhole apparatus 10' is illustrated in various configurations of use. (Note that the screens 2' and chambers 14' are only partially illustrated in FIGS. 4*a* to 4*f*). As will be described further below, the main components of the downhole apparatus 10' are a tubular body 24', a first valve arrangement 126', a second valve arrangement 226', activation chambers 14' and components of the sand screen 2', as described above. The first valve arrangement 126' is associated with the first ports 24*a*' and the second valve arrangement 226' is associated with the second ports 24*b*'. The first and second valve arrangements 126', 226' are arranged axially in series along the tubular body 24'. In this arrangement the first and second valve arrangements 126', 226' are adjacent one another. However, it should be appreciated that the first and second valve arrangements 126', 226' could be at opposite ends of the sand screen 2'.

In addition to the above components, the downhole apparatus 10' also comprises: a valve joint section (not illustrated), which may be used to connect the lower end of the dual valve arrangement 26' to the upper end of an adjacent valve arrangement/sand screen section, or a bull nose end seal, if the dual valve arrangement 26' is the last valve arrangement of the apparatus; and a screen joint section (not illustrated), which may be used to connect the upper end of the dual valve arrangement 26' (sand screen) to the lower end of an adjacent valve arrangement.

The tubular body 24' is a generally cylindrical member that defines first ports 24*a*' and second ports 24*b*'. The tubular body 24' comprises a first upper portion 24*c*' and a second lower portion 24*d*'.

First and second ports 24*a*' and 24*b*' are apertures in the wall of the tubular body 24'. In the embodiment illustrated and described here the tubular body 24' includes a plurality of first and second ports 24*a*', 24*b*' circumferentially arranged around the tubular body 24'.

First Valve Arrangement

The first valve arrangement 126' is illustrated in FIGS. 4*a* to 4*f*.

In the embodiment illustrated and described here the first valve arrangement 126' is a single valve and has an upper end 26*a*' and a lower end 26*b*'. The first valve arrangement 126' includes a first valve member 26*c*'. The first valve member 26*c*' has an upper end 26*h*' and a lower end 26*i*'. The first valve member 26*c*' is a generally cylindrical member that includes a first port 26*d*' in the wall thereof. The first port 26*d*' is an aperture in the wall. The first valve member 26*c*' includes a plurality of first ports 26*d*' circumferentially arranged around the first valve member 26*c*'. Each first port 26*d*' includes a sealing member 26*f*' positioned on either side of the first port 26*d*'. The sealing member 26*f*' is configured to provide a fluid seal between the first ports 26*d*' of the first valve member 26*c*' and the tubular body 24', such that the first ports 24*a*' of the tubular body 24' may be sealed when pressurised fluid is being passed through the ports, or isolated when fluid is not being passed through the ports.

As described further below, the first ports 26*d*' of the first valve member 26*c*' are associated with the first port 24*a*' of the tubular body 24', and the first valve member 26*c*' is moveable with respect to the tubular body 24'. The first valve member 26*c*' is a sleeve member and is configured to slide within the tubular body 24' to open and/or close the first ports 24*a*' of the tubular body 24'. As described further below, the first valve arrangement 126' is configurable to control the flow of fluid through the first ports 24*a*' of the tubular body 24'.

The first ports 24*a*' of the tubular body 24' are activation ports and are arranged to provide fluid communication with the activation chambers 14'. As described further below, fluid pressure within the tubular body 24' may be communicated to the chambers 14' through the first ports 24*a*' via operation of the first valve member 26*c*'. Each first port 24*a*' includes a check valve 24*e*' that is arranged to permit fluid flow through the port 24*a*' (and first valve arrangement 126') in one direction and to prevent fluid to flow through the port 24*a*' (and first valve arrangement 126') in an opposite direction. The check valve 24*e*', and hence the first port 24*a*', is configured to permit fluid to flow through the first port 24*a*' from the inside of the tubular body 24' to the chamber 14'. In this configuration, the chambers 14', once activated, remain activated. As described above, activation of the chambers 14' activates the sand screens 2'. The sand screens 2' therefore also remain activated once the chambers 14' have been activated.

The first valve arrangement 126' includes a spring member 36' (an example of a biasing device) located between the first valve member 26*c*' and the second portion 24*d*' of the tubular body 24'. The spring member 36' is configured to apply a biasing force to the first valve member 26*c*' to bias the first valve member 26*c*' to a position where the first port 24*a*' is closed.

Figure 4A:
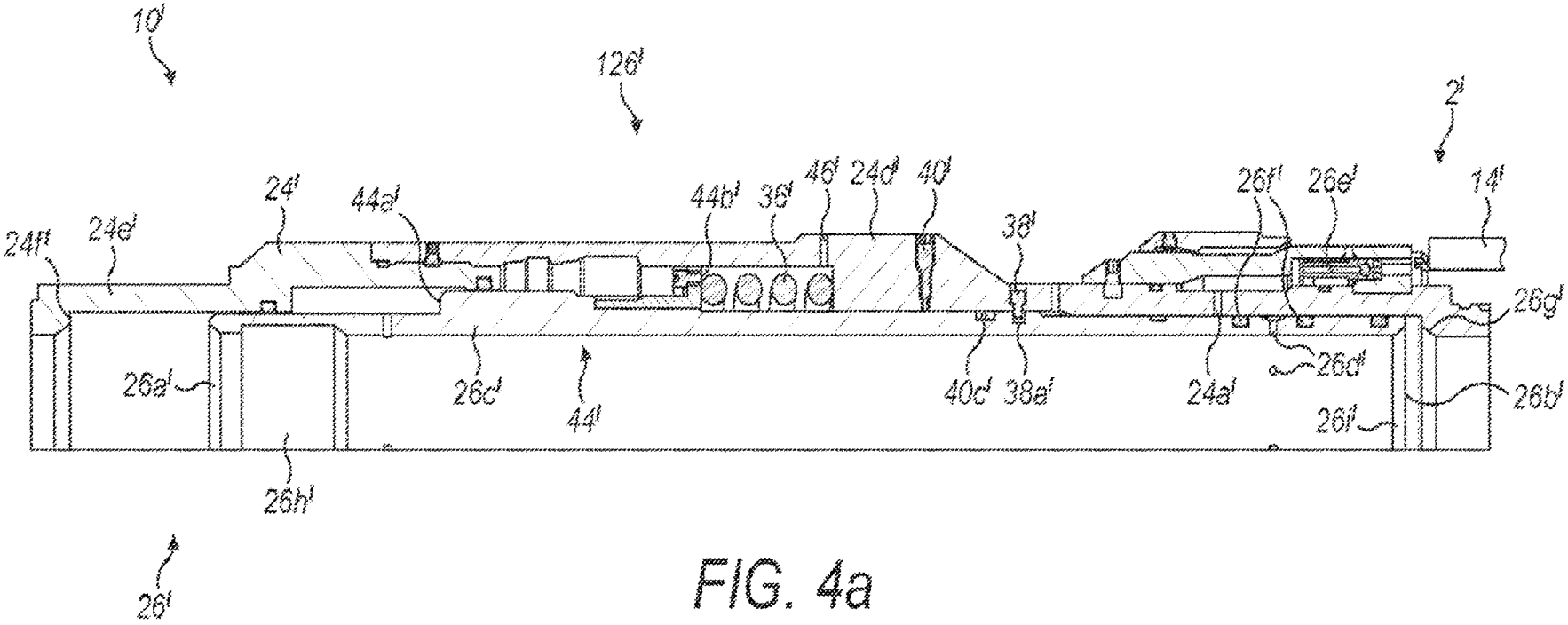
FIGS. 4*a* to 4*f* are split sectional side views of a first valve arrangement of a second embodiment of a downhole apparatus of the present invention in a locked first configuration (initial configuration), a first intermediate configuration, a locked second configuration, a second intermediate configuration, a loose piston configuration and a third intermediate configuration, respectively.

The first valve arrangement 126' also comprises a plurality of primary retaining members 38' (an example of one or more locking devices). As illustrated in FIG. 4*a*, the primary retaining members 38' are configured to lock the first valve member 26*c*' in position relative to the tubular body 24'. In the embodiment illustrated and described here the primary retaining members 38' are shear screws. The primary retaining members 38' are therefore releasable retaining members. The retaining members 38' may be configured to lock in grooves 38*a*' in the first valve member 26*c*'.

The first valve arrangement 126' also comprises a plurality of secondary retaining members 40' (an example of one or more locking devices). As illustrated in FIG. 4*a*, the secondary retaining members 40' are configured to lock the first valve member 26*c*' in position relative to the tubular body 24'. In the embodiment illustrated and described here the secondary retaining members 40' are shear screws. The secondary retaining members 40' are therefore releasable retaining members. The retaining members 40' may be configured to lock in grooves 40*c*' in the first valve member 26*c*'.

In the configuration illustrated in FIG. 4*a*, the primary retaining members 38' are engaged with the first valve member 26*c*' to hold the first valve member 26*c*' in the locked position and the second retaining members 40' are disengaged from the first valve member 26*c*'. In the configuration illustrated in FIG. 4*c*, the primary retaining members 38' are disengaged from the first valve member 26*c*' and the second retaining members 40' are engaged with the first valve member 26*c*' to hold the first valve member 26*c*' in the locked position. The second retaining members 40' are biased towards the first valve member 26*c*'. The second retaining members 40' are biased towards the first valve member 26*c*' by a spring member 40*a*'.

The first valve arrangement 126' also comprises a further retaining member 42' (an example of one or more locking devices). The retaining member 42' is configured to lock the first valve member 26*c*' in position relative to the tubular body 24'. The retaining member 42' is defined by the tubular body 24' and is configured to receive and engage with a complimentary-shaped portion, or profile, of the first valve member 26*c*', as illustrated in FIG. 4*f* The retaining member 42' may be released via mechanical override, mechanical actuation. The retaining member 42' may therefore be releasable.

The first valve arrangement 126' also includes a piston device 44'. The piston device 44' is a differential pressure piston. The piston device 44' is operable to arrange the first valve arrangement 126' in various configurations, as described further below. The piston device 44' is operable to move the first valve member 26*c*' relative to the tubular body 24'. The first valve arrangement 126' defines the differential pressure piston device 44'. The differential pressure piston device 44' being arranged between the first valve member 26*c*' and the first and second portions 24*c*', 24*d*' of the tubular body 24'. The piston device 44' has a first operating surface 44*a*', which may be exposed to a fluid pressure within the tubular body 24', and a second operating surface 44*b*', which is subject to a biasing force from the spring member 36' (an example of a biasing device). The differential piston device 44' operates between a first operating seal diameter (first operating surface 44*a*') and a second (smaller) operating seal diameter (created by sealing member 26*f*'). The spring member 36' is located between the second operating surface 44*b*' and the second portion 24*d*' of the tubular body 24'. As described above, the spring member 36' is operable to bias the first valve member 26*c*' to a position where the first port 24*a*' is closed.

The first valve arrangement 126' also comprises pressure balancing ports 46'. The pressure balancing ports 46' are associated with the differential piston device 44'. The pressure balancing ports 46' are provided in the wall of the tubular body 24' and provide fluid communication between the inside and outside of the tubular body 24'. The second operating surface 44*b*' of the differential piston 44' is exposed to an external fluid pressure by the pressure balancing ports 46', i.e., the second operating surface 44*b*' of the differential piston is exposed to a fluid pressure between the tubular body 24' and the well bore, such as annulus pressure. The second operating surface 44*b*' may therefore be subject to fluid pressure in the annulus between the tubular body 24' and the well bore and a biasing force from the spring member 36'.

In the embodiment illustrated and described here the first valve arrangement 126' is therefore a fluid pressure-responsive valve arrangement. The first valve arrangement 126' being hydraulically-operable via pressurised fluid applied to the apparatus 10'.

Second Valve Arrangement

The second valve arrangement 226' is illustrated in FIGS. 5*a* to 5*e*.

In the embodiment illustrated and described here the second valve arrangement 226' has a second valve member 226*c*' that comprises a first portion 226*a*' and a second portion 226*b*'. As described further below, the first and second portions 226*a*', 226*b*' are slidably moveable with respect to one another and may be telescopically arranged, such that the first portion 226*a*' may receive a portion of the second portion 226*b*' therein. The first and second portions 226*a*', 226*b*' are locked together by shear screws, or pins, 39' (an example of a retaining member and a releasable retaining member). As described further below, the first and second portions 226*a*', 226*b*' also include a further retaining member 43' (an example of a further locking device). In the embodiment illustrated and described here the retaining member 43' comprises collet fingers 45' arranged on the second portion 226*b*' that are configured to engage with grooves 45*a*' on the tubular body 24' and grooves 45*b*' on the first portion 226*a*'. The retaining member 43' may be released via mechanical override, mechanical actuation. The retaining member 43' may therefore be releasable.

The first portion 226*a*' has an upper end 226*d*' and a lower end 226*e*'. The first portion 226*a*' is a generally cylindrical member. The first portion 226*a*' includes a spring member 236' (an example of a biasing device) located between the first portion 226*a*' of the second valve member 226*c*' and the second portion 24*d*' of the tubular body 24'. The spring member 236' is configured to apply a biasing force to the second valve member 226*c*' to bias the second valve member 226*c*' to a position where the second port 24*b*' is open.

The second portion 226*b*' has an upper end 226*f* and a lower end 226*g*'. The second portion 226*b*' is a generally cylindrical member that includes a second port 26*e*' in the wall thereof. The second port 26*e*' is an aperture in the wall. The second valve member 226*c*' includes a plurality of second ports 26*e*' circumferentially arranged around the second portion 226*b*' of the second valve member 226*c*'. Each second port 26*e*' includes a sealing member 126*f* positioned on either side of the second port 26*e*'. The sealing member 126*f* is configured to provide a fluid seal between the second ports 26*e*' of the second portion 226*b*' of the second valve member 226*c*' and the tubular body 24', such that the second ports 24*b*' of the tubular body 24' may be sealed when pressurised fluid is being passed through the ports, or isolated when fluid is not being passed through the ports.

As described further below, the second port 26*e*' of the second valve member 226*c*' is associated with the second port 24*b*' of the tubular body 24', and the second valve member 226*c*' is moveable with respect to the tubular body 24'. The second valve member 226*c*' is a sleeve member and is configured to slide within the tubular body 24' to open and/or close the second ports 24*b*' of the tubular body 24'. As described further below, the second valve arrangement 226' is configurable to control the flow of fluid through the second ports 24*b*' of the first portion 24*c*' of the tubular body 24'.

The second ports 24*b*' of the tubular body 24' are production ports and are arranged to provide fluid communication between the interior of the tubular body 24' and the exterior of the tubular body 24'. As described further below, the second ports 24*b*' are configured to permit flow of production fluid from a wellbore formation into the tubular body 24', and/or to permit treatment fluid to flow from the tubular body 24' to the wellbore formation. The treatment fluid may pass through a sand filter to the formation.

Each second port 24*b*' may include an inflow control device (ICD) 34'.

Figure 5A:
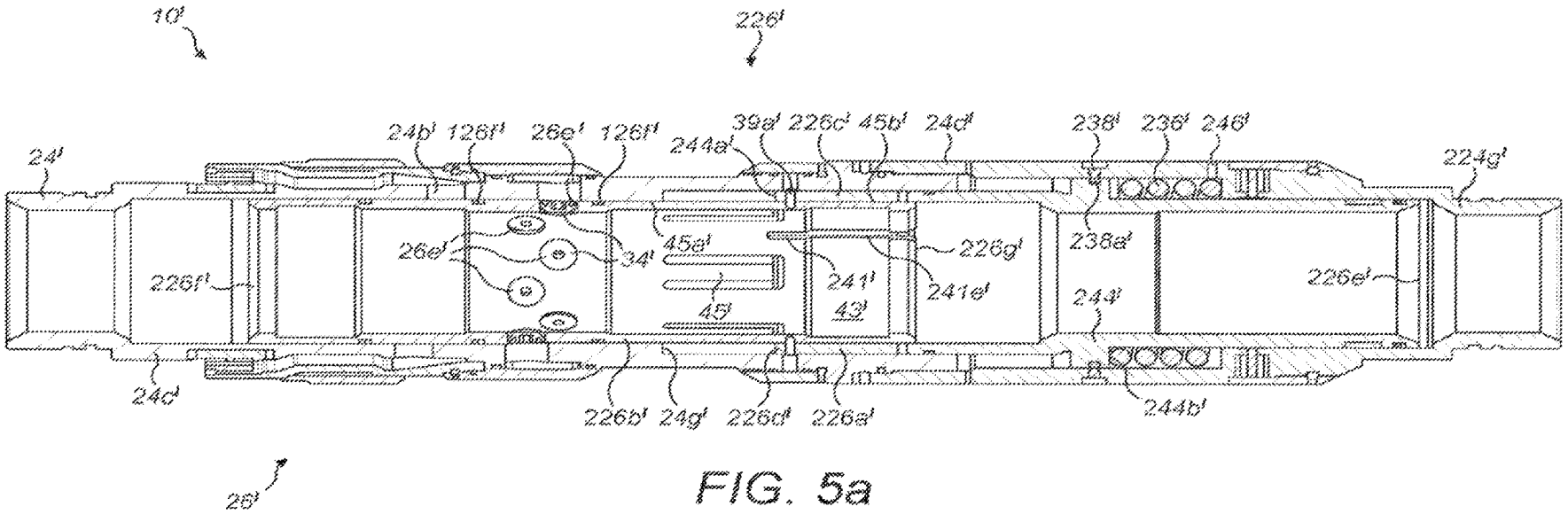
FIGS. 5*a* to 5*e* are sectional side views of a second valve arrangement of a second embodiment of a downhole apparatus of the present invention in a locked first configuration (initial configuration), a fourth intermediate configuration, a third configuration, a fourth configuration, and a re-opened third configuration, respectively.

The second valve arrangement 226' also comprises a plurality of primary retaining members 238' (an example of one or more locking devices). As illustrated in FIG. 5*a*, the primary retaining members 238' are configured to lock the second valve member 226*c*' in position relative to the tubular body 24'. In the embodiment illustrated and described here the primary retaining members 238' are shear screws. The primary retaining members 238' are therefore releasable retaining members. The retaining members 238' may be configured to lock in grooves 238*a*' in the second valve member 226*c*'.

The second valve arrangement 226' also comprises a timing pin 241' (see FIG. 5*a*). The timing pin 241' is mounted on the tubular body 24', or first portion 226*a*', and is configured to engage with a timing pin slot 241*a*' (see FIG. 5*a*) in the second portion 226*b*' of the second valve member 226*c*'. The timing pin 241' and timing pin slot 241*a*' are configured to prevent rotation of the second valve member 226*c*' relative to the tubular body 24' during use.

The second valve arrangement 226' also includes a piston device 244'. The piston device 244' is a differential pressure piston. The piston device 244' is operable to arrange the second valve arrangement 226' in various configurations, as described further below. The piston device 244' is operable to move the second valve member 226*c*' relative to the tubular body 24'. The second valve arrangement 226' defines the differential pressure piston device 244'. The differential piston device 244' being arranged between the first and second portions 24*c*', 24*d*' of the tubular body 24' and the first and second portions 226*a*', 226*b*' of the second valve member 226*c*'. The piston device 244' has a first operating surface (or area) 244*a*', which may be exposed to a fluid pressure within the tubular body 24', and a second operating surface (or area) 244*b*', which is subject to a biasing force from the spring member 236' (an example of a biasing device). The differential piston device 244' operates between a first operating seal diameter (first operating surface 244*a*') and a second (smaller) operating seal diameter (created by sealing member 126*f*).

The spring member 236' is located between the second operating surface 244*b*' and the second portion 24*d*' of the tubular body 24'. As described above, the spring member 236' is operable to bias the second valve member 226*c*' to a position where the second port 24*b*' is open.

The second valve arrangement 226' also comprises pressure balancing ports 246'. The pressure balancing ports 246' are associated with the differential piston device 244'. The pressure balancing ports 246' are provided in the wall of the second portion 24*d*' of the tubular body 24' and provide fluid communication between the inside and outside of the tubular body 24'. The second operating surface 244*b*' of the differential piston 244' is exposed to an external fluid pressure by the pressure balancing ports 246', i.e., the second operating surface 244*b*' of the differential piston is exposed to a fluid pressure between the tubular body 24' and the well bore, such as annulus pressure. The second operating surface 244*b*' may therefore be subject to fluid pressure in the annulus between the tubular body 24' and the well bore and a biasing force from the spring member 236'.

In the embodiment illustrated and described here the second valve arrangement 226' is therefore a fluid pressure-responsive valve arrangement. The second valve arrangement 226' being hydraulically-operable via pressurised fluid applied to the apparatus 10'.

Operation of Dual Valve Arrangement

The operation of the dual valve arrangement 26' and activation of the chambers 14' will now be described with reference to FIGS. 4*a* to 5*c* and 6*b*.

The dual valve arrangement 26' may have a locked first configuration, in which the first port 24*a*' is closed and the second port 24*b*' is closed; a locked second configuration, in which the first port 24*a*' is open and the second port 24*b*' is closed; and a third configuration, in which the first port 24*a*' is closed and the second port 24*b*' is open.

Locked 1st Configuration

FIGS. 4*a* and 5*a* (Point A—FIG. 6*b*) illustrate the locked first configuration of the dual valve arrangement 26', in which both the first ports 24*a*' and the second ports 24*b*' are closed. This configuration may be an initial configuration of the dual valve arrangement 26' and may be the configuration in which the downhole apparatus 10' is entered (or run in (RIH)) to a borehole of a well. During run in, the pressure balancing ports 46', 246' allow the apparatus 10' to be pressure-balanced during deployment. This configuration also allows for a wash down and/or circulation of filter cake treatment to take place prior to activation of the sand screens 2'. Note that circulation of fluid on run in requires an open end, i.e., the lowermost end of the completion must be open. The system circulation flow path is closed before pressurised fluid is applied to the apparatus 10'.

As illustrated in FIG. 4*a*, the first valve member 26*c*' of the first valve arrangement 126' is locked in position relative to the tubular body 24' by the primary retaining members 38'. In this position the secondary retaining members 40' are disengaged from the first valve member 26*c*', the upper end 26*h*' of the first valve member 26' is spaced from a shoulder portion 24*f* of the first portion 24*c*' of the tubular body 24', the lower end 26*i*' of the first valve member 26' is spaced from a seat portion 24*g*' of the tubular body 24', the retaining member 42' is disengaged and the spring member 36' is compressed.

Also, as illustrated in FIG. 5*a*, the second valve member 226*c*' of the second valve arrangement 226' is locked in position relative to the tubular body 24' by the primary retaining members 238'. In this position the first and second portions 226*a*', 226*b*' of the second valve arrangement 226' are locked together with retaining pins 39', the lower end 226*e*' of the second valve member 226*c*' is spaced from a seat portion 224*g*' of the tubular body portion 24', the retaining member 43' is disengaged, the upper end 226*f*' of the second valve member 226*c*' is spaced from a shoulder portion 24*g*' of the tubular body portion 24' and the spring 236' is compressed.

The chambers 14' are also in an inactive (deflated) state. This corresponds to FIG. 2*a*.

Figure 6B:
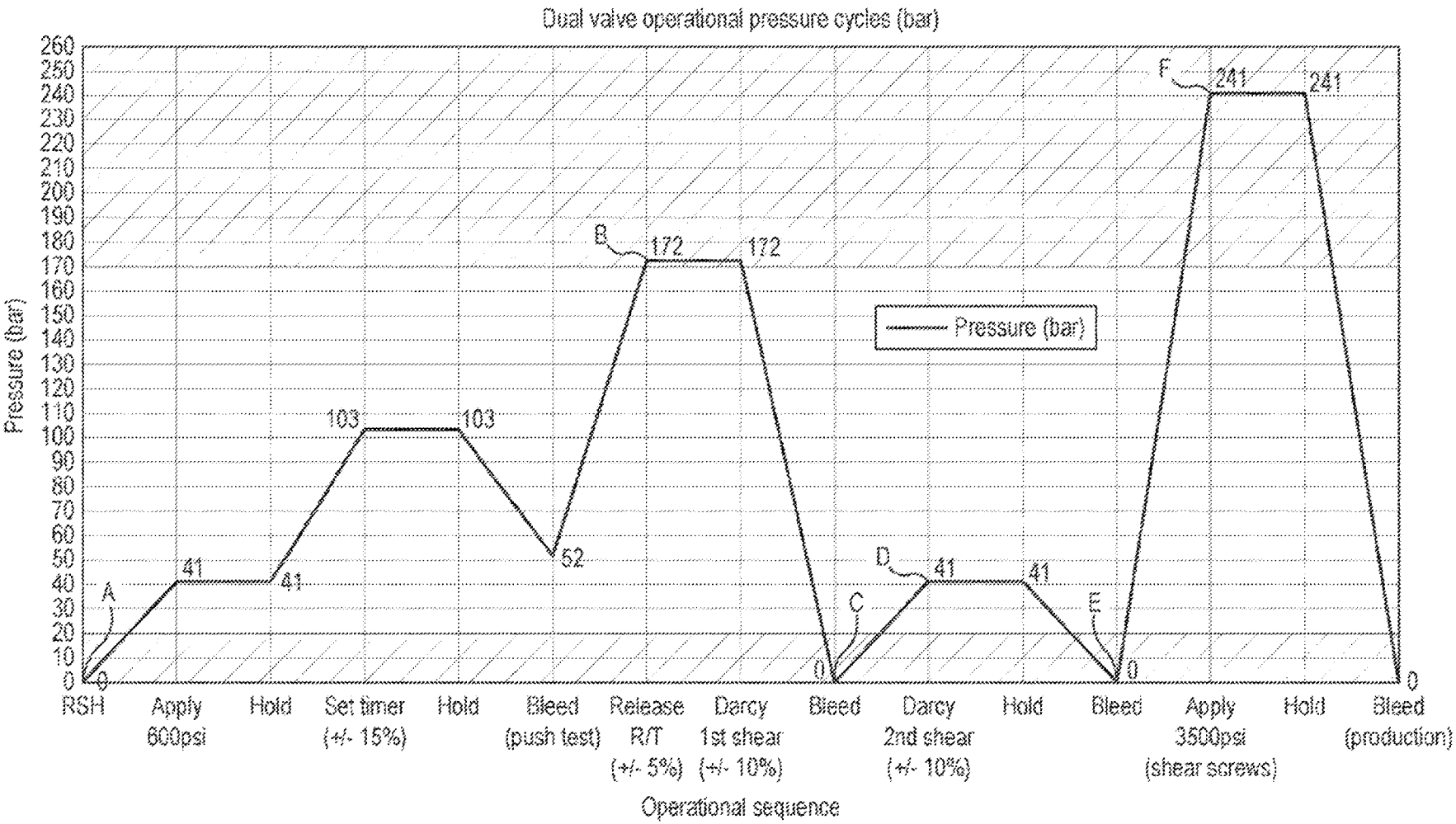
FIG. 6*b* is a graph detailing the pressure cycle of the downhole apparatus of FIGS. 4*a* to 5*c* during operation.

Once the lowermost end of the apparatus 10 is closed, there is initially no pressurised fluid inside the tubular body 24' (this may be an example of a first fluid pressure). This is illustrated in FIG. 6*b* at the RIH position. As described below, once pressurised fluid is applied to the apparatus 10', the chambers 14' are isolated from this pressure.

The dual valve arrangement 26' is now moved to a first intermediate configuration (Point B—FIG. 6*b*). This involves operation only of the first valve arrangement 126'.

1st Intermediate Configuration

Figure 4B:
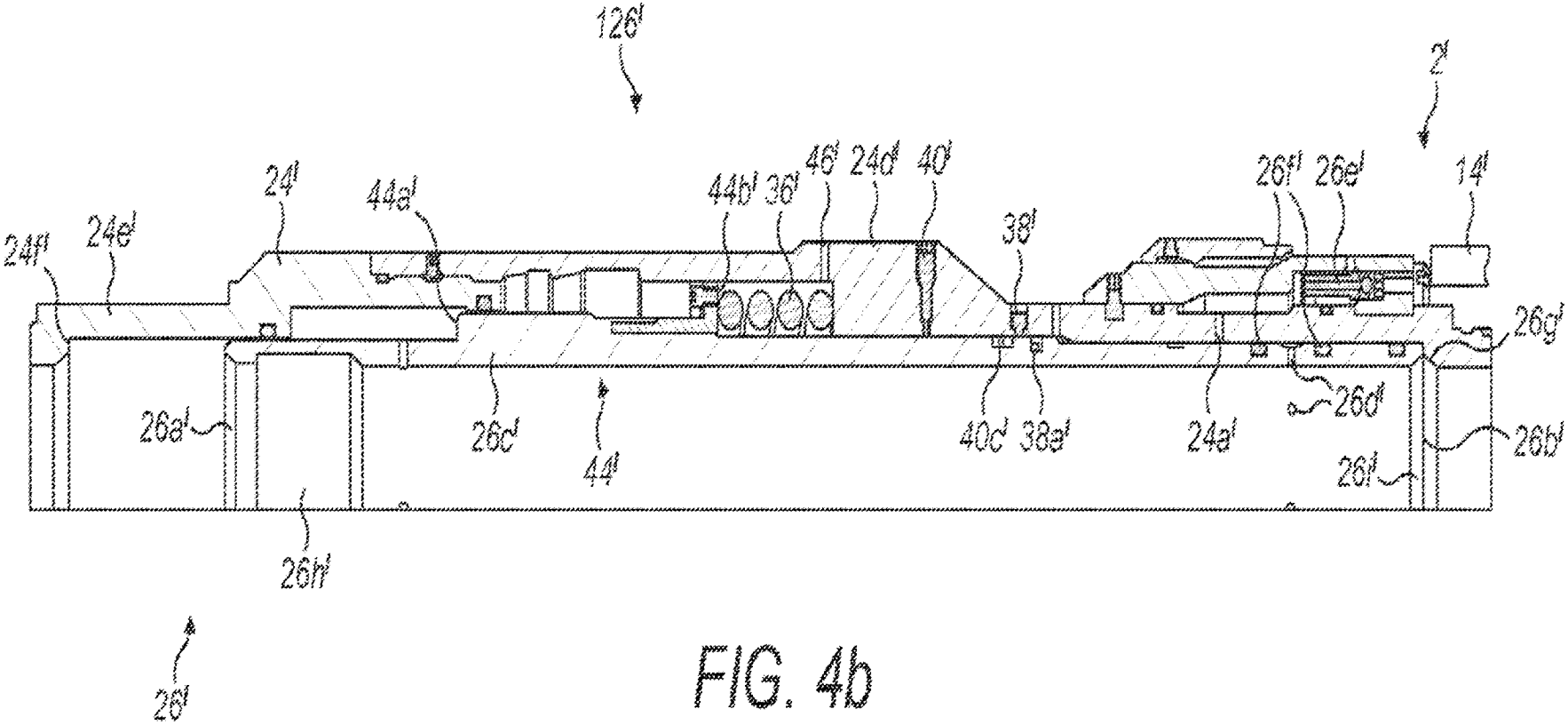

FIG. 4*b* (Point B—FIG. 6*b*) illustrates a first intermediate configuration of the dual valve arrangement 26', in which the first valve arrangement 126' is unlocked and the first ports 24*a*' and the second ports 24*b*' are closed.

With the lowermost end of the apparatus 10' closed, the inside of the tubular body 24' is pressurised with fluid from the surface. In the embodiment described here and illustrated in FIG. 6*b*, the pressure is initially increased to 600 psi (approx. 41 bar) (this may be an example of a first fluid pressure) and held for a period of time before being raised to 1500 psi (approx. 103 bar) (this may be an example of a first fluid pressure) to allow a liner to bet set. The pressure is held at this pressure for a period of time before being reduced (bled off) to 750 psi (approx. 52 bar). The pressure is then increased to 2500 psi (approx. 172 bar) (this is an example of a second fluid pressure).

Increasing the pressure to 2500 psi moves the first valve member 26*c*' downwards and causes the primary retaining members 38' to be released (sheared). This is effected by applying a greater force to the first operating surface (area) 44*a*' than the second operating surface (area) 44*b*' of the differential piston device 44'.

In this position the secondary retaining members 40' are disengaged from the first valve member 26*c*', the upper end 26*h*' of the first valve member 26' is spaced from the shoulder portion 24*f*' of the first portion 24*c*' of the tubular body 24', the lower end 26*i*' of the first valve member 26' is seated against the seat portion 24*g*' of the tubular body 24', the retaining member 42' is disengaged and the spring member 36' is further compressed. The chambers 14' are also in an inactive (deflated) state and remain isolated from the internal pressurised fluid in the tubular body 24'. This operation may be termed the primary shear (1st shear).

The dual valve arrangement 26' is now moved to the locked second configuration (Point C—FIG. 6*b*). This involves operation only of the first valve arrangement 126'.

Locked 2nd Configuration

Figure 4C:
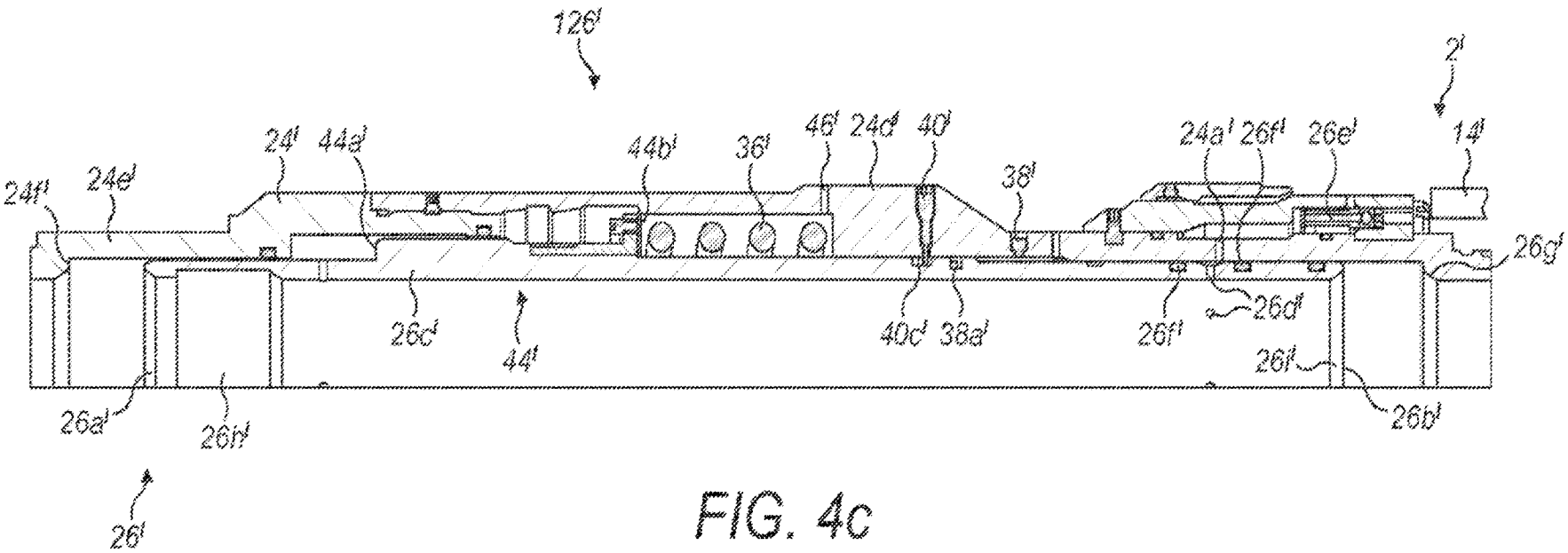

FIG. 4*c* (Point C—FIG. 6*b*) illustrates the locked second configuration of the dual valve arrangement 26', in which the first ports 24*a*' are open and the second ports 24*b*' are closed.

To move the first valve arrangement 126' from the first intermediate configuration to the second locked configuration the fluid pressure in the tubular body 24' is reduced (bled off). As illustrated in FIG. 6*b*, the fluid pressure is reduced from 2500 psi to approx. 0 psi (an example of a third fluid pressure). With the valve member 26' locked inadvertent activation of the screen is prevented. Decreasing the pressure towards 0 psi causes the first valve member 26*c*' to move upwards and the secondary retaining members 40' to engage with the first valve member 26*c*'. This is effected by the spring member 36' applying a greater force to the second operating surface (area) 44*b*' than the fluid pressure acting on the first operating surface (area) 44*a*' of the differential piston device 44'.

As described above, the secondary retaining members 40' are spring biased towards the valve member 26*c* via spring member 40*a*'. In this position the first valve member 26*c*' is locked relative to the tubular body 24' and the first ports 24*a*' are open. The chambers 14' are also in an inactive (deflated) state but are no longer isolated from the internal pressurised fluid in the tubular body 24'. As illustrated in FIG. 4*c*, the first ports 24*a*' are aligned with the first ports 26*d*' of the first valve member 26*c*'.

In this configuration the chambers 14' may now be activated by filling them with pressurised fluid from the tubular body 24'. Pressurised fluid is passed through the first ports 26*d*' of the first valve member 26*c*', the first ports 24*a*' of the tubular body 24' and through the one way check valves 24*e*' to inflate the chambers 14'. Note the activated chambers 14' are omitted from FIG. 4*c*. This corresponds to FIG. 2*b*.

In this position the upper end 26*h*' of the first valve member 26*c*' is spaced from the shoulder portion 24*f* of the first portion 24*c*' of the tubular body 24', the lower end 26*i*' of the first valve member 26*c*' is spaced from the seat portion 24*g*' of the tubular body 24', the retaining member 42' is disengaged and the spring member 36' is extended. This operation may be termed the activation state.

As illustrated in FIG. 6*b*, the fluid pressure is increased toward 600 psi (approx. 41 bar). The chambers 14' may be fully activated at a lower pressure than 600 psi, such as 400 psi. This ensures that all the chambers 14' are activated.

Increasing the fluid pressure towards 600 psi moves the first valve arrangement 126' towards a second intermediate configuration (Point D—FIG. 6*b*). This involves operation only of the first valve arrangement 126'.

2$^{nd}$ Intermediate Configuration

Figure 4D:
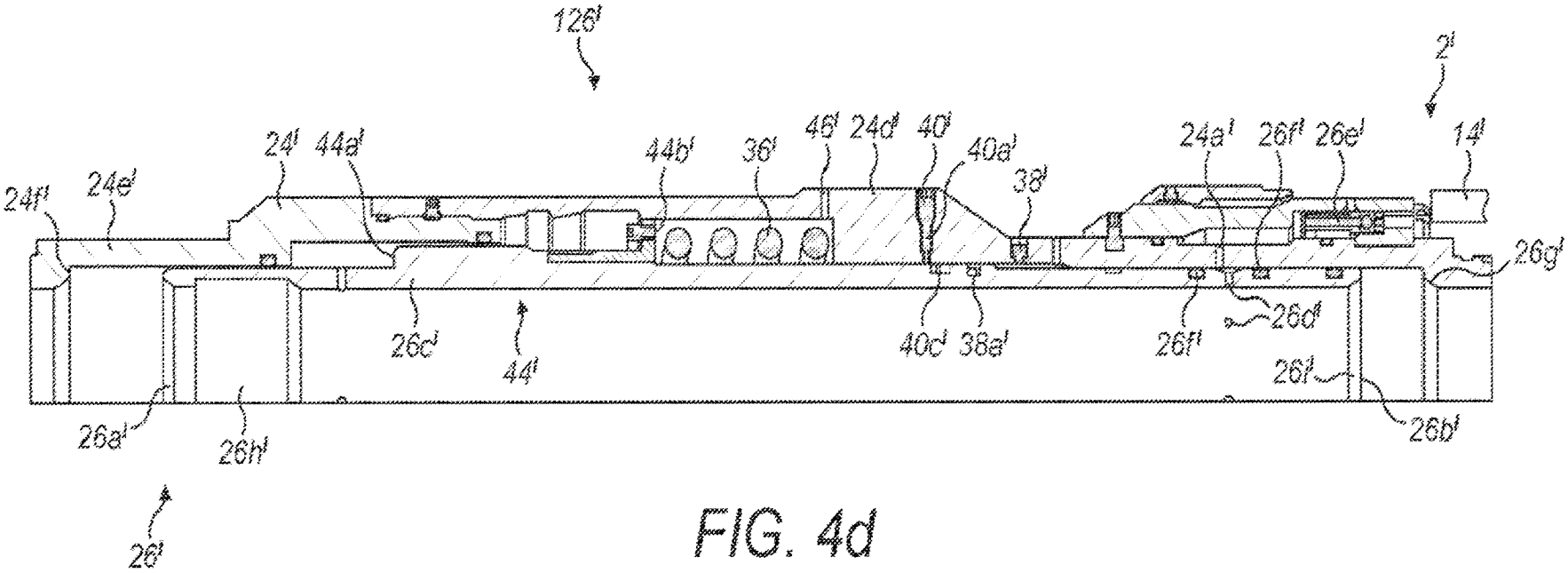
Figure 4E:
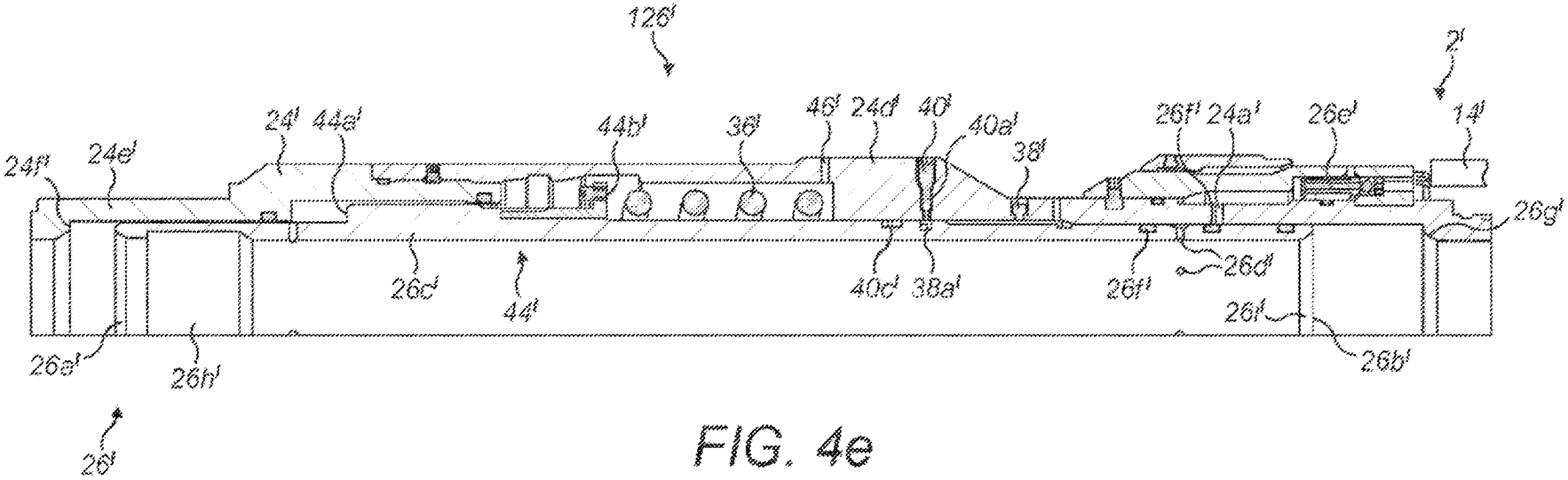
Figure 4F:
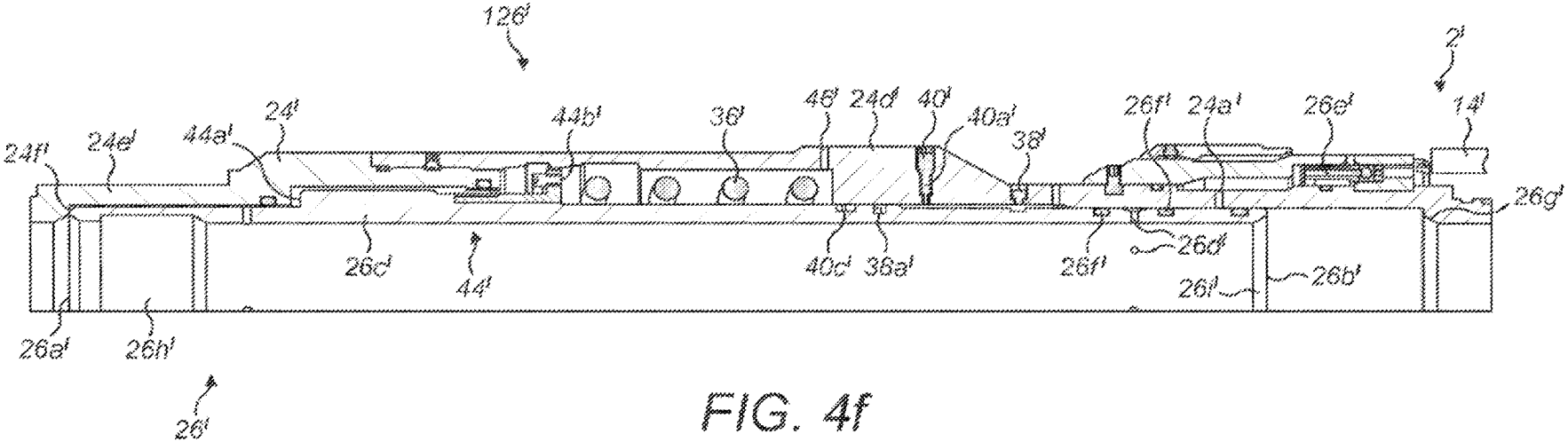

FIGS. 4*d* and 4*e* (Point D—FIG. 6*b*) illustrates a second intermediate configuration of the dual valve arrangement 26', in which the first valve arrangement 126' is unlocked and the first ports 24*a'* and the second ports 24*b'* are closed.

Increasing the fluid pressure towards 600 psi (this is an example of a fourth fluid pressure) moves the first valve member 26*c'* downwards and causes the secondary retaining members 40' to be released (sheared). This is effected by applying a greater force to the first operating surface (area) 44*a'* than the second operating surface (area) 44*b'* of the differential piston device 44'. As illustrated in FIG. 6*b*, the fluid pressure is held at 600 psi for a period of time. This ensures that all retaining members 40' are sheared. This pre-sets the final pressure in the chambers 14'. This means that the retaining members set the activation pressure.

In this position the upper end 26*h'* of the first valve member 26*c'* is spaced from the shoulder portion 24*f* of the first portion 24*c'* of the tubular body 24', the lower end 26*i'* of the first valve member 26*c'* is spaced from the seat portion 24*g'* of the tubular body 24', the retaining member 42' is disengaged and the spring member 36' is recompressed. The chambers 14' are also in an activated state and are isolated from the internal pressurised fluid in the tubular body 24'. Pressurised fluid is thus locked into the chambers 14'. This operation may be termed the secondary shear.

The dual valve arrangement 26' is now moved to the third intermediate configuration (Point E—FIG. 6*b*).

3$^{rd}$ Intermediate Configuration

FIG. 4*f* (Point E—FIG. 6*b*) illustrates an intermediate locked third configuration of the dual valve arrangement 26', in which the first ports 24*a'* are closed and the second ports 24*b'* are closed.

To move the first valve arrangement 126' from the second intermediate configuration to the locked third intermediate configuration the fluid pressure in the tubular body 24' is reduced (bled off). As illustrated in FIG. 6*b*, the fluid pressure is reduced from 600 psi to approx. 0 psi. Decreasing the pressure towards 0 psi causes the first valve member 26*c'* to move upwards and the retaining member 42' to engage with the first valve member 26*c'*. That is, as the pressure is bled off, the spring member 36' applies a greater force than the differential pressure across the differential piston device 44'.

In this position the first valve member 26*c'* is locked relative to the tubular body 24' and the first and second ports 24*a*, 24*b'* are closed. The chambers 14' are also in an activated state and are isolated from the internal pressurised fluid in the tubular body 24'. This configuration allows for the screens 2' to be activated, but not on production, i.e., no production fluid passing through the second ports 24*b'*.

In this position the upper end 26*h'* of the first valve member 26*c'* abuts against the shoulder portion 24*f'* of the first portion 24*c'* of the tubular member 24', the lower end 26*i'* of the first valve member 26*c'* is spaced from the seat portion 24*g'* of the tubular body 24', the retaining member 42' is engaged and the spring member 36' is re-extended.

The dual valve arrangement 26' is now moved to a fourth intermediate configuration (Point F—FIG. 6*b*). This involves operation only of the second valve arrangement 226'.

4$^{th}$ Intermediate Configuration

Figure 5B:
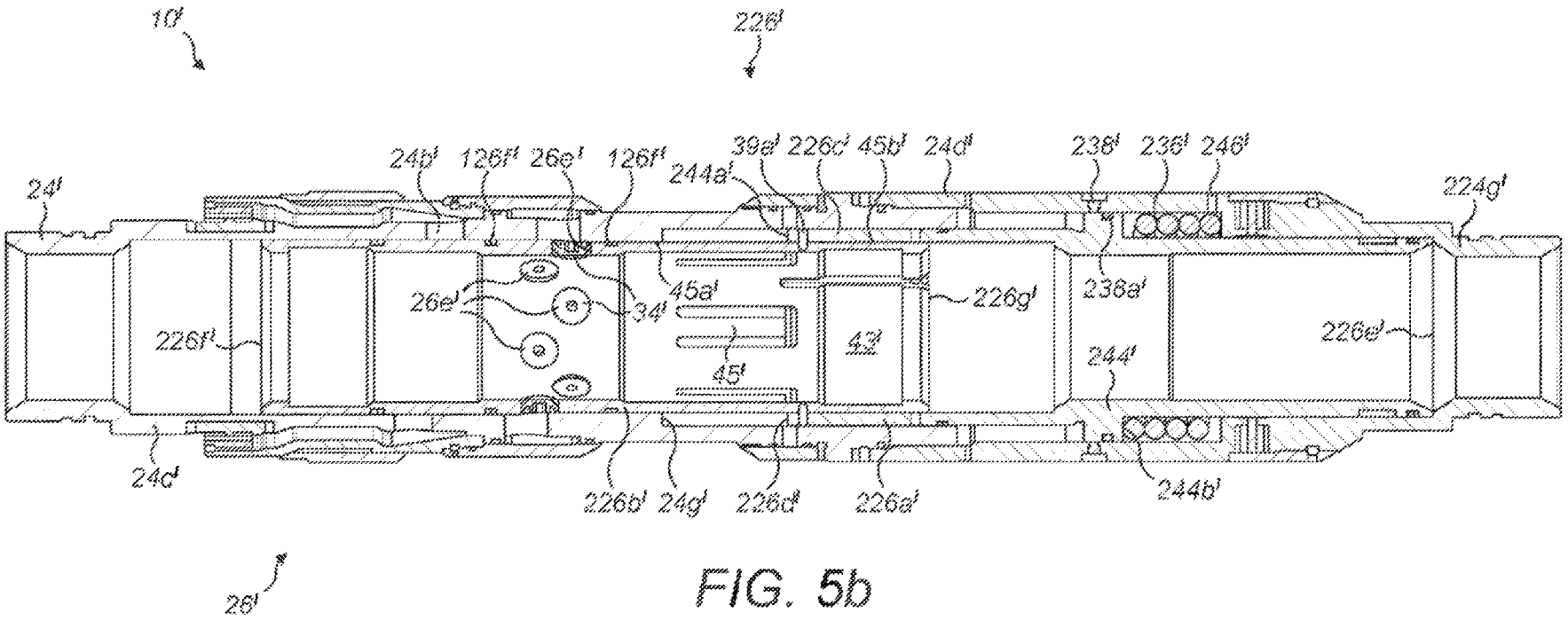

FIG. 5*b* (Point F—FIG. 6*b*) illustrates an intermediate fourth configuration of the dual valve arrangement 26', in which the second valve arrangement 226' is unlocked, first ports 24*a'* are closed and the second ports 24*b'* are closed.

In the embodiment described here and illustrated in FIG. 5*b*, the pressure in the tubular body 24' is increased to 3500 psi (approx. 241 bar) (an example of a fourth fluid pressure). Increasing the pressure to 3500 psi moves the second valve member 226*c'* downwards and causes the primary retaining members 238' to be released (sheared). This is effected by applying a greater force to the first operating surface (area) 244*a'* than the second operating surface (area) 244*b'* of the differential piston device 244'. That is, the primary retaining members 238' are sheared due to the pressure differential created by different piston areas acting in opposing directions. The primary retaining members 238' are sheared due to the force difference created between the first operating seal (large diameter) (first operating surface 244*a'*) and the second (smaller) diameter operating seal (created by sealing member 126*f*).

In this position the second valve member 226*c'* of the second valve arrangement 226' is unlocked, the first and second portions 226*a'*, 226*b'* of the second valve arrangement 226' are locked together with retaining pins 39', the lower end 226*e'* of the second valve member 226*c'* is seated on the seat portion 224*g'* of the tubular body portion 24', the retaining member 43' is disengaged, the upper end 226*d'* of the first portion 226*a'* of the second valve member 226*c'* is spaced from a shoulder portion 24*g'* of the tubular body 24' and the spring 236' is compressed. This operation may be termed the primary shear of the second valve arrangement 226'.

The dual valve arrangement 26' is now moved to the locked third configuration (Point G—FIG. 6*b*). This involves operation only of the second valve arrangement 226'.

3$^{rd}$ Configuration

Figure 5C:
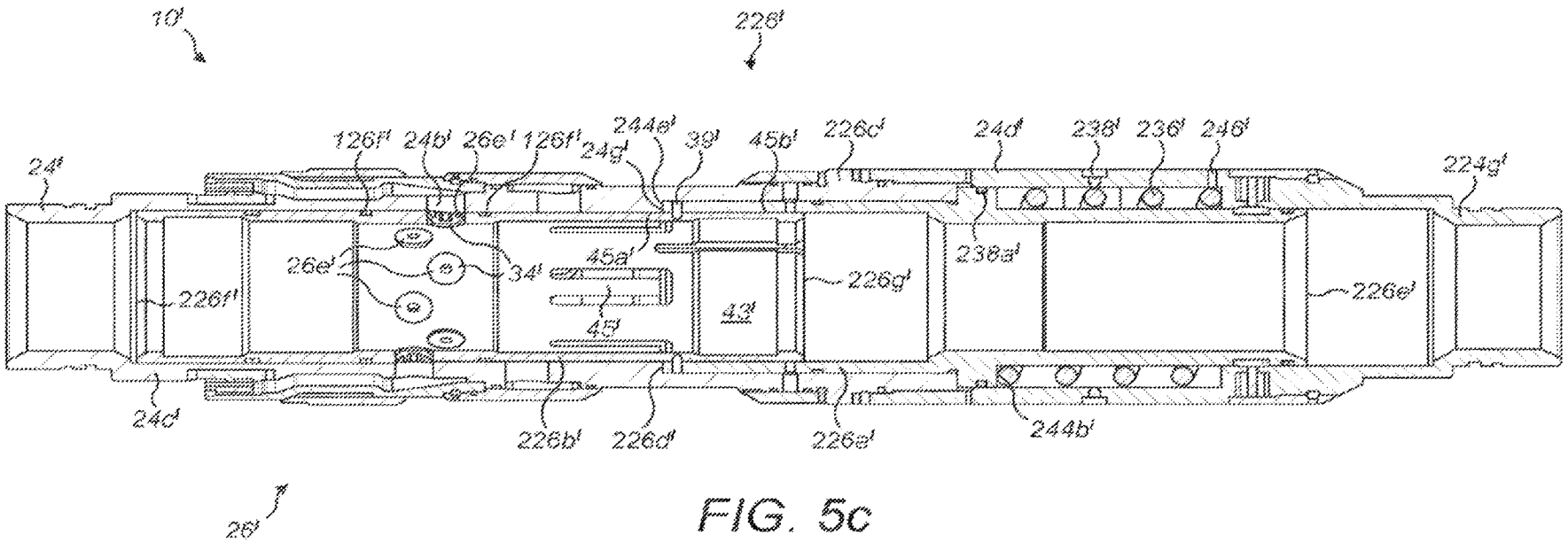

FIG. 5*c* (Point G—FIG. 6*b*) illustrates a locked third configuration of the dual valve arrangement 26', in which the first ports 24*a'* are closed and the second ports 24*b'* are open. FIGS. 4*f* and 5*c* together illustrate the locked third configuration of the dual valve arrangement 26'.

To move the second valve arrangement 226' from the intermediate fourth configuration to the locked third configuration the fluid pressure in the tubular body 24' is reduced (bled off). As illustrated in FIG. 6*b*, the fluid pressure is reduced from 3500 psi to approx. 0 psi.

Decreasing the pressure towards 0 psi causes the second valve member 226*c'* to move upwards and the collet fingers 45' of the retaining member 43' to engage with the grooves 45*a'* of the retaining profile 227' of the first portion 226*a'*. That is, as the pressure is bled off, the spring member 236' applies a greater force than the differential pressure across the differential piston device 244'.

In this position the second valve member 226*c'* is locked relative to the tubular body 24' and the second ports 24*b'* are open. The chambers 14' are also in an activated state and are isolated from the internal pressurised fluid in the tubular body 24'. As illustrated in FIG. 5*c*, the second ports 24*b'* are aligned with the second ports 26*e'* of the second valve member 226*c'*.

In this configuration fluid communication can occur between the formation (reservoir), the tubular body 24' and the surface. Production fluid may now pass from the formation through the second ports 24*b'* and into the tubular body 24'.

In this position the collet fingers 45' of the retaining member 43' of the first and second portions 226*a*', 226*b*' are engaged with the grooves 45*a*' of the tubular body 24', the first and second portions 226*a*', 226*b*' of the second valve arrangement 226' are locked together with retaining pins 39', the lower end 226*e*' of the second valve member 226*c*' is spaced from the seat portion 224*g*' of the tubular body portion 24', upper end 226*d*' of the first portion 226*a*' of the second valve member 226*c*' abuts against the shoulder portion 24*g*' of the tubular body portion 24' and the spring 236' is extended. This operation may be termed the production state.

$4^{th}$ Locked Configuration

The dual valve arrangement 26' may also have a locked fourth configuration, in which the second valve member 226*c*' is locked and the first and second ports 24*a*', 24*b*' are closed.

The locked fourth configuration may be achieved after the third configuration. The locked fourth configuration of the second valve arrangement 226' is one where the second valve arrangement 226' is moved from a production position to a shut-off position.

Figure 5D:
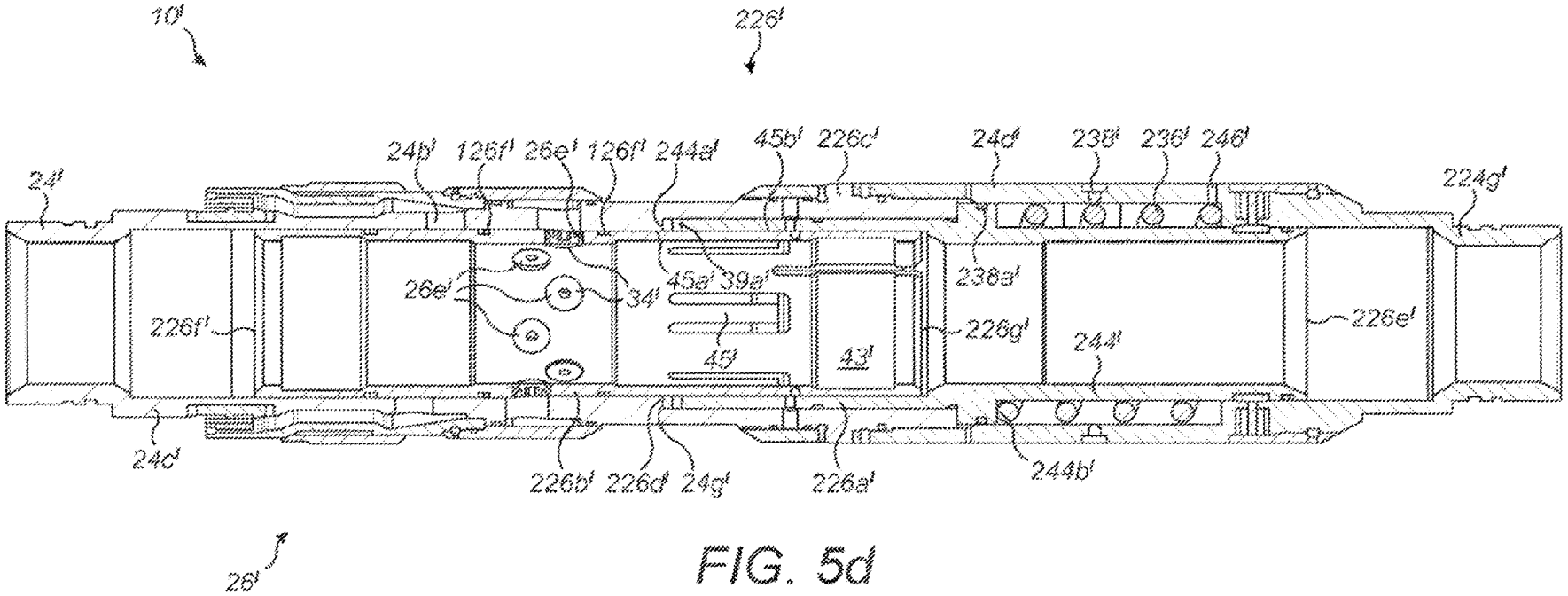

The fourth configuration may be achieved by mechanical intervention, e.g., by using a shifting tool to mechanically move the second valve member 226*c*' to a position where the first and second ports 24*a*', 24*b*' are closed and the second valve member 226*c*' is locked relative to the tubular body 24'. This arrangement is illustrated in FIG. 5*d*. As illustrated, the second portion 226*b*' of the second valve member 226*c*' has been moved downwards, the collet fingers 45' of the retaining member 43' of the first and second portions 226*a*', 226*b*' have been disengaged from the grooves 45*a*' of the tubular body 24' and the shear pins 39' have been released (sheared). This movement also causes the collet fingers 45' of the retaining member 43' to engage with the grooves 45*b*' of the first portion 226*a'*.

Figure 5E:
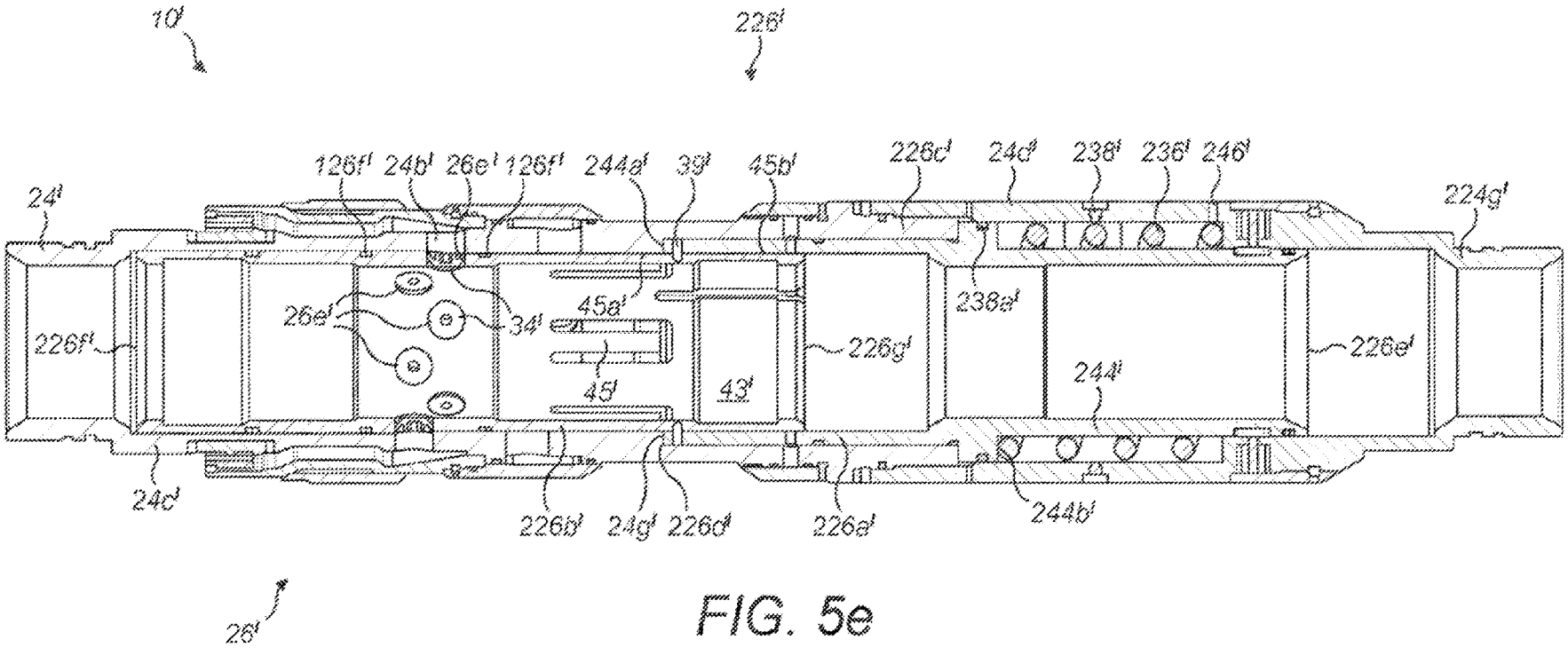

Should the dual valve arrangement 26' be required to be moved back to a production position, this process can be reversed to move the dual valve arrangement 26' back to the production position of FIG. 5*c*. This re-opened position is illustrated in FIG. 5*e*.

The downhole apparatus 10, 10', systems and methods of the present invention prevent inadvertent, or premature, activation of sand screens (or other fluid pressure-actuated tools or devices) during the initial run in hole (RIH) operation. The present invention allows the downhole apparatus to be deployed with a far greater pressure window that has previously been available with similar apparatus. The present invention provides for an operating pressure window of approximately 2500 psi. This allows the apparatus to be run in hole (RIH) with pressure differentials between the interior and exterior of the tubular body/base pipe of up to 2500 psi.

The present invention also provides a method of allowing high rate fluid circulation without the concern of premature activation of the screen.

The multi-cycle pressure operation of the apparatus of the present invention prevents inadvertent, or premature, activation of sand screens (or other fluid pressure-actuated tools or devices). The first locked configuration of the apparatus 10, 10' of the present invention prevents the inadvertent activation release of the screen 2.

Furthermore, the apparatus of the present invention provides for repeated operation (opening and closing) of the production ports via mechanical intervention. This is particularly useful where certain valves are required to be closed and reopened during the operation of the apparatus. Also, the ability to open and close the production ports provides the user with flexibility in setting up a series of apparatuses with some screens being operable hydraulically and some screens being operable mechanically.

The present invention provides a method of setting a sand control completion, extending the sand control filter element thereof to a wellbore surface and isolating the reservoir from an upper portion of the wellbore. The upper portion of the wellbore may be the wellbore above a packer element. This eliminates the requirement for a reservoir/formation isolation valve, which are typically ball valves that are problematic to open and encourage sediments from the upper completion above to settle out on top of the valve, thus making the valve difficult to open. The requirement for reservoir/formation isolation valve can bel eliminated because the production valve has not been opened.

The present invention provides a method of setting a sand control completion, extending the sand control filter element thereof to a wellbore surface and isolating the surface of the wellbore from the wellbore fluids. The wellbore fluids may be muds polymers etc.

Modifications and improvements may be made to the above without departing from the scope of the present invention. For example, the pressures recited above are examples only. The pressures required to operate the apparatus will be determined by the requirements of the user. The pressures required by the user will also determine the types of retaining member, releasable locking devices, etc., used with the apparatus.

Also, it should be appreciated that the location of the piston devices and biasing devices may be varied from the above-described embodiments.

Depending on the relative location and arrangement of the piston devices and biasing devices in the apparatus, the actuation of the valve members of the valve arrangements may be opposite to those described above.

Furthermore, although the apparatus 10, 10 has been illustrated above as being hydraulically operated, it should be appreciated that the apparatus, and valve arrangements thereof, may be entirely mechanically actuated. It should also be appreciated that the operation of the apparatus, and valve arrangements thereof, may be a combination of hydraulic-operation and mechanical operation. That is, any operation described above as being carried out hydraulically, could be carried out mechanically, and any operation described above as being carried out mechanically, could be carried out hydraulically.

Also, it should be appreciated that the valve of each apparatus 10, 10' may be operated by mechanical intervention individually and separately from one another. The method therefore comprises the step of operating the valve arrangement to open and/or close selected valve members, and ports.

Furthermore, it should also be appreciated that numerous screens and valves can be connected together and run into a bore hole. Also, multiple valves may be mechanically operated in a single run. It should also be appreciated that the valves of each apparatus may be solely mechanically operable.

What is claimed is:

1. A method of operating a valve arrangement of a downhole apparatus comprising a tubular body having first and second tubular ports in a wall thereof, the method comprising:

operating the valve arrangement from a locked first configuration, in which the first tubular port is closed and the tubular second port is closed, to a locked second configuration, in which the first tubular port is opened causing activation fluid to expand an activation chamber of the downhole apparatus into contact with a wellbore wall and the second tubular port is closed, wherein the valve arrangement includes a valve member including a first valve port, the first valve port associated with the first tubular port, and a second valve port associated with the second tubular port, wherein the valve arrangement comprises a retaining member;

operating the valve arrangement from the locked second configuration to a third configuration in which the first tubular port is closed and the second tubular port is opened causing reservoir fluid to flow into the tubular body; and locking the valve member in the third configuration with the retaining member.

2. The method of claim 1, wherein the valve arrangement includes a piston device operable to arrange the valve arrangement in the locked first configuration, the locked second configuration, the third configuration, a fourth configuration, a first intermediate configuration or a second intermediate configuration.

3. The method of claim 2, comprising operating the piston device to arrange the valve arrangement in the first configuration, the locked second configuration, the third configuration, the fourth configuration, the first intermediate configuration or the second intermediate configuration.

4. The method of claim 2, comprising operating the piston device by controlling an internal tubular body fluid pressure to arrange the valve arrangement in the first configuration, the second configuration, the third configuration, the fourth configuration, the first intermediate configuration or the second intermediate configuration.

5. The method of claim 1, wherein the first valve port is configured to permit fluid to flow in one direction and prevent fluid flow in an opposite direction and wherein the method comprises communicating fluid through the first valve port.

6. The method of claim 1, wherein the first valve port provides fluid communication with a tool or a device and wherein the method comprises communicating fluid through the first valve port to the tool or device.

7. The method of claim 6, wherein the tool or the device is a sand control element including the activation chamber.

8. The method of claim 7, wherein the second valve port provides fluid communication between an interior of the tubular body and an exterior of the tubular body, or between the exterior of the tubular body and the interior of the tubular body and wherein the method comprises communicating fluid through the second port.

9. The method of claim 1, wherein the reservoir fluid flows through a sand control element before flowing through the second tubular valve.

10. The method of claim 1, wherein the downhole apparatus comprises two or more valve arrangements, each valve arrangement being associated with the first valve port and the second valve port, or a pair of first and second valve ports and wherein the method comprises operating each of the two or more valve arrangements.

11. The method of claim 10, comprising:

operating each valve arrangement simultaneously, independently or sequentially.

12. The method of claim 1, wherein the valve arrangement comprises a first valve arrangement and a second valve arrangement, the first valve arrangement being associated with the first tubular port and the second valve arrangement being associated with the second tubular port and wherein the method comprises operating the first valve arrangement and the second valve arrangement.

13. The method of claim 12, comprising:

operating the first valve arrangement and the second valve arrangement independently, or sequentially.

14. The method of claim 12, wherein the first and second valve arrangement have a first configuration, in which the first and second valve arrangements are locked and the first and second tubular ports are closed; a second configuration, in which the first and second valve arrangements are locked, the first tubular port is open and the second tubular port is closed; and the third configuration, in which the first valve arrangement is locked, the first tubular port is closed and the second tubular port is open.

15. The method of claim 14, wherein the locked first configuration is an initial configuration of the valve arrangement.

16. The method of claim 14, wherein the method comprises operating the first and second valve arrangements from the locked first configuration to the locked second configuration, and the locked second configuration to the third configuration.

17. The method of claim 14, wherein the locked first configuration is followed by the locked second configuration and the locked second configuration is followed by the third configuration.

18. The method of claim 14, comprising:

initially running the downhole apparatus, while the downhole apparatus is in the locked first configuration, into a bore hole of a subterranean formation.

19. The method of claim 14, comprising:

unlocking the first valve arrangement from the locked first configuration; and moving the first valve arrangement to a first intermediate configuration between the first configuration and the second configuration, in which the first valve arrangement is unlocked, the second valve arrangement is locked and the first and second tubular ports are closed.

20. The method of claim 14, comprising:

unlocking the first valve arrangement from the locked second configuration; and moving the first valve arrangement to a second intermediate configuration between the second configuration and the third configuration, in which the first valve arrangement is unlocked, the second valve arrangement is locked and the first and second tubular ports are closed.

21. The method of claim 20, comprising:

locking the first valve arrangement in the second intermediate configuration.

22. The method of claim 21, comprising:

unlocking the second valve arrangement from the second intermediate configuration.

23. The method of claim 14, comprising:

locking the first and second valve arrangements in the third configuration.

24. The method of claim 14, comprising:

operating the first and second valve arrangements from the third configuration to a fourth configuration, in which the first tubular port is closed and the second tubular port is closed.

25. The method of claim 24, wherein the fourth configuration is reached after the first and second valve arrangements have been moved through the first, second and third configurations.

26. The method of claim 24, comprising:

locking the first and second valve arrangements in the fourth configuration.

27. The method of claim 14, wherein the valve arrangement is a fluid pressure-responsive valve arrangement or a hydraulically-actuated valve arrangement.

28. The method of claim 14, wherein the first configuration is associated with a first fluid pressure, the second configuration is associated with a second fluid pressure, the second fluid pressure being higher than the first fluid pressure, and the third configuration is associated with a third fluid pressure, the third fluid pressure being lower than the second fluid pressure.

* * * * *